United States Patent [19]

Yoshida et al.

[11] Patent Number: 4,801,526

[45] Date of Patent: Jan. 31, 1989

[54] SILVER HALIDE PHOTOGRAPHIC LIGHT-SENSITIVE MATERIAL

[75] Inventors: Eiji Yoshida; Akio Suzuki; Satoru Nagasaki; Masumi Arai; Iku Metoki; Haruhiko Sakuma, all of Hino, Japan

[73] Assignee: Konica Corporation, Japan

[21] Appl. No.: 161,454

[22] Filed: Feb. 18, 1988

Related U.S. Application Data

[63] Continuation-in-part of Ser. No. 897,650, Aug. 18, 1986, abandoned.

[30] Foreign Application Priority Data

Aug. 20, 1985 [JP] Japan ..... 60-181050
Sep. 6, 1985 [JP] Japan ..... 60-195936

[51] Int. Cl.[4] ..... G03C 1/02; G03C 5/24; G03C 1/06

[52] U.S. Cl. ..... 430/567; 430/434; 430/437; 430/438; 430/569; 430/588; 430/599; 430/966

[58] Field of Search ..... 430/567, 569, 588, 599, 430/966, 434, 438, 437

[56] References Cited

U.S. PATENT DOCUMENTS 4,497,895 2/1985 Matsuzaka et al. ..... 430/569
4,659,654 4/1987 Metoki et al. ..... 430/567
4,668,614 5/1987 Takada et al. ..... 630/567

*Primary Examiner*—Mukund J. Shah
*Attorney, Agent, or Firm*—Jordan B. Bierman

[57] ABSTRACT

A silver halide photographic light-sensitive material comprising a specific silver halide grain is disclosed. The siliver halide grain contains a localized portion containing 20 mol % or more of silver iodide and average content of silver iodide of which grain is from 0.1 to 10.0 mol %, provided that the silver halide grain is prepared by mixing an aqueous solution containing a water soluble halide compound and an aqueous solution containing a water soluble silver salt under a condition that pAg of the mixture is raised at 9.7 or more during a period after a half amount of the silver salt to be used has been added to the mixture. The photographic light-sensitive material has improved photographic characteristics and is suitable for radiographic use.

7 Claims, 2 Drawing Sheets

SILVER HALIDE PHOTOGRAPHIC LIGHT-SENSITIVE MATERIAL

This application is a continuation in part of Ser. No. 897,650 Aug. 18, 1986, now abandoned.

BACKGROUND OF THE INVENTION

The present invention relates to a silver halide photographic light-sensitive material, and more particularly to a silver halide photographic light-sensitive material suitable for radiographic use having a high sensitivity, wide exposure range, excellent graininess sharpness and preservability, and producing little or no fog under a safelight.

More and more complex and diverse demands have lately been made for improving the characteristics of silver halide photographic light-sensitive materials, and especially for the realization of a high-speed or ultra-high-speed silver halide photographic light-sensitive material having stable photographic characteristics. Particularly, in photographic light-sensitive materials for radiography use, in order to lessen the exposure dose of X rays against the human body, the photographic light-sensitive material is strongly desired to be so highly sensitive as to enable the obtaining of more information with less exposure dose of X rays and so improved as to produce a high-quality image with less fog.

Increasing the sensitivity of the silver halide photographic light-sensitive material (hereinafter may be called light-sensitive material) is carried out most generally by making larger the size of the silver halide contained in an emulsion layer, by the optical sensitization with use of sensitizing dyes, or the like.

It is well-known that, if the silver halide grain size is made larger, the sensitivity thereof increases. However, the light-sensitive material which uses a large-grain-size silver halide emulsion has the disadvantage that it tends to produce an increased fog or to be desensitized during the storage thereof; i.e., the preservability thereof is deteriorated, and to produce a fog due to a safelight.

A large number of prior-art techniques such as the incorporation of various additives have hitherto been disclosed for the improvement of the preservability of the silver halide photographic light-sensitive material and also for reducing the safelight fog of the photographic light-sensitive material, but it is the status quo that many of them are accompanied by undesirable secondary effects such as desensitization, and no satisfactory techniques for improving particularly the preservability of high-speed light-sensitive materials containing large-size silver halide grains have yet been obtained. In addition, such undesirable phenomena as the deterioration of the covering power with the increase in the grain size, the increase in the desensitization of the light-sensitive mateial when subjected to a mechanical pressure such as fold, and the like, also increase, so that raising the sensitivity by increasing the grain size has its limit.

Inparticular, most of the silver halide emulsions of conventional type silver halide photographic light-sensitive materials have so far used a silver halide grains having a wide grain-size distribution. Therefore, it has not always positively affirmed that an optimum chemical sensitization have been applicable to silver halide grains having every grain-size, accordingly the intrinsic sensitivity of each silver halide grain has not satisfactorily been displayed.

From the above-mentioned aspects, the techniques for making a photographic speed higher have very often been applied to silver halide photographic light-sensitive materials. The techniques of using a twin-crystal type silver halide grain are disclosed in Japanese Patent O.P.I. Publication Nos. 153428/1977, 145827/1979 and 142329/1980 and others; the techniques of using a flat-plate shaped silver halide grain are disclosed in Japanese Patent O.P.I. Publication Nos. 12792/1983, 95337/1983, 108526/1983, 111937/1983 and 113928/1983, and others; and the techniques of using a monodisperse emulsion are disclosed in Japanese Patent O.P.I. Publication Nos. 207597/1981, 178235/1982 and 49938/1983; Japanese Patent Application Nos. 53043/1983 and 54949/1983; and others. In the above-mentioned techniques, however, it has been hard to manufacture any silver halide photographic light-sensitive material which displays few fogginess and high sensitivity without affecting any other photographic characteristics.

For raising the sensitivity with the same grain size; i.e., for sensitizing methods, there are a variety of techniques. For example, a method for incorporating a development accelerator such as a thioether into an emulsion, a method for the supersensitization of a spectrally sensitized silver halide emulsion by the combined use of appropriate optical sensitizers, improved chemical sensitization techniques, and the like, have been reported. However, these methods or techniques are not necessarily applicable widely to high-speed silver halide photographic light-sensitivematerials. The silver halide emulsion to be used in a high-speed silver halide photographic light-sensitive material, since it is chemically sensitized to the utmost possible extent, when such above methods are applied, has the disadvantage that it tends to produce a fog during the storage thereof or a fog due to a safelight, or the like.

Japanese Patent Examined Publication No. 8831/1970 discloses a method of carrying out chemical sensitization by use of gold(I) mercaptide, but this method also has the disadvantage that, when the method is used alone, the stability of the light-sensitive material against heat is largely deteriorated and besides, the actual sensitivity of the light-sensitive material when exposed for a long period to a low-illuminance light is deteriorated, thereby causing the deterioration of the low-intensity reciprocity law failure characteristic.

Further, Japanese Patent Examined Publication No. 24937/1981 discloses the use of thiosuccinimide-type compounds for chemical sensitization, but this method is not enough to provide any adequate sensitization.

On the other hand, optical sensitization also is a useful sensitization means. For example, in the field of medical radiography, those conventional regular-type films sensitive to a wavelength region around 450 nm have now been replaced by orthochromatic-type photographic films orthochromatically sensitized to be further sensitive to the wavelength region range of from 540 to 550 nm. The wavelength region to which thus sensitized light-sensitive materials are sensitive is extended and at the same time the sensitivity of such materials is increased, thus allowing to reduce the exposure dose of X rays to thereby lessen its influence upon the human body. Thus, the optical sensitization is a very useful sensitization means, but there are many problems yet to be solved. For example, there are many cases where, if the combination of or the using quantities in combination of photographic emulsions, sensitizers and other additives are inappropriate, they lead to the impairment of the sensitizability or to the deterioration of the preservability of the resulting light-sensitive material, thus making it difficult to obtain adequate effects. Particularly in a high-speed light-sensitive material which uses large-size silver halide grains, the above-mentioned disadvantage tends to appear significantly, so that there is much room for further improvement.

SUMMARY OF THE INVENTION

It is therefore an object of the present invention to provide a silver halide photographic light-sensitive material suitable for radiographic use which is free of the above-mentioned disadvantage of conventional techniques and has a high sensitivity and a wide exposure range and which is excellent in the graininess, sharpness and preservability, and produces little or not fog due to a safelight.

The above object is accomplished by a silver halide photographic light-sensitive material comprising a support and at least one silver halide photographic emulsion layer provided on the support, at least one silver halide emulsion layer containing a silver halide grain which has a localized portion containing 20 mol% or more silver iodide and average silver iodide content of which grain is from 0.1 to 10 mol%, provided that said silver halide grain is prepared by mixing an aqueous solution containing a water soluble halide compound and an aqueous solution containing a water soluble silver salt under a condition that pAg of the mixture is raised to between 9.7 and 12.5 during a period after a half amount of the silver salt to be used has been added to the mixture.

DETAILED DESCRIPTION OF THE INVENTION

In the preparation of the silver halide grains in accordance with the invention, it is preferred that a pAg value is to be adjusted to not less than 9.7 and not more than 12.5 at the time when completing the preparation by changing a pAg value instantly or gradually in the stage after an amount of silver formed or deposited reaches not less than one half of a total amount of silver to be prepared; and it is further preferred that a pAg value is to be adjusted to not less than 9.7 and not more than 12.5 at the time when completing a preparation by changing a pAg value gradually at the point of time when an amount of silver formed or deposited is from $\frac{2}{3}$ to 9/10 of a total amount of silver to be prepared.

Figure 1:
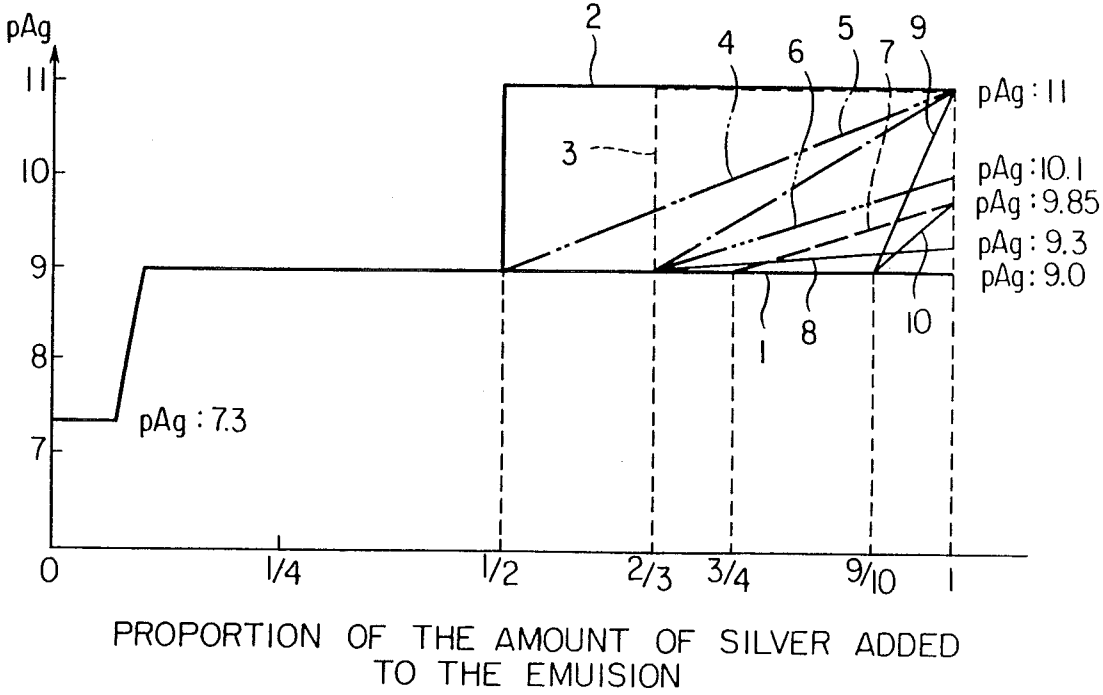
FIG. 1 is a chart illustrating the pAg variation patterns in preparing silver halide grains.

FIG. 1 is the examples of various patterns of pAg value adjustments in the preparation of the emulsions of the invention; wherein (2) and (3) show the examples that pAg values are raised intermittently up to 11 at the point of time when an amount of silver added reaches $\frac{1}{2}$ and $\frac{2}{3}$, respectively, and (4), (5), (6), (7), (9) and (10) show the examples that pAg values are raised continuously from the point of time when an amount of silver added reaches a prescribed proportion up to the prescribed value of between 9.7 and 12.5, i.e., pAg=11, 10.1 and 9.85.

To simplify the drawing, it illustrates only the case where the variations of pAg values are linear. In the invention, however, a pAg value may be adjusted up to between 9.7 and 12.5, provided the adjustment is to be made within the range where a content of silver added is not less than one half of a total amount of silver added. There are also many variations of such adjustments including, for example, one case that a pAg raising line is curved or another case that a pAg reaches a prescribed value before a total amount of silver is added and the value is kept constant.

In the meantime, FIG. 1 shows an example that the pAg is 7.3 in the initial stage of mixing operation and the pAg is 9.0 in the stage before starting the adjustment. These pAg values may be determined in accordance with the composition, grain-size, configuration and the like of silver halide grains aimed to obtain. It is the matter of course that such values shall not be limited to the values indicated in the drawing.

In the drawing, (1) and (8) are the examples of the patterns not in accordance with the invention.

More particularly, it is preferred that, when using the above-mentioned silver halide grain, it is of the mono-dispersion type in grain-size distribution. The term, 'mono-dispersion', mentioned herein means a grain dispersion within the range that 95% of the grains are not more than ±60% and more preferably not more than ±40% in number-average grain-size. The term, 'number-average grain-size', means a number-average value of the respective diameters of the projective areas of grains.

It is allowed in the invention to select any contents of silver halide grains in an emulsion layer, however, the contents thereof is preferably not less than 40% and more preferably not less than 90%, in terms of silver, to a total quantity of silver halide grains.

It is also allowed to use a plurality of different sized emulsions relating to the invention mixed together.

The sizes of silver halide grains used in the invention are preferably from 0.1 to 8.0 μm and more preferably from 0.3 to 1.5 μm.

The silver halide grains may be comprised of such a silver halide as silver chloroiodobromide, silver chloride, silver chlorobromide, silver bromide, silver iodobromide, silver iodide and the like, and silver iodobromide is preferable from the viewpoint of obtaining a high sensitivity. Further, an average silver iodide content in silver iodobromide is from 0.1 to 10 mol% and preferably from 1 to 8 mol%.

The silver halide grains of the invention have some portions inside thereinside where localize silver iodide of such a high content as is not less than 20 mol%, and the silver iodide localized portions are to preferably be as far inside as possible from the outer surface of each grain and more preferably be not less than 0.01 μm far from the outer surface thereof.

Such localized parts may be present in the layer-form in the grains of the whole core body of the grain may be so formed into the so-called core/shell type structures as to serve as such a localized part. In this instance, it is preferred that a part of or the whole of the core portion of a grain except the shell portions of not less than 0.01

μm in thickness from the outer surface of the grain is to be a localized part containing silver iodide in an amount of not less than 20 mol%.

A silver iodide content in the localized parts is to preferably be within the range of from 30 to 40 mol%.

It is preferred that a silver iodide content in the localized portions is to be not less than 20 mol% greater than that of the layer inner than the localized portions.

As for the processes for providing a localized part of such a high silver iodide content as is at least 20 mol% or higher to the inside of each silver halide grain used in the invention (that is, preferably, the inside of each grain not less than 0.01 μm far from the outer wall of each grain), it is preferable to use a seed crystal, however, it is also allowed not to use such a seed crystal.

If not to use such a seed crystal, there is not such a silver halide as is capable of becoming a nucleus growable before starting a ripening in a reaction liquid phase containing a protective gelatin (hereinafter called a mother liquid). Therefore, a grown nucleus is formed by supplying a silver ion and a halide ion containing a highly concentrated iodine of at least 20 mol% or more. A further supply thereof is still continued so as to grow a grain out of the grown nucleus. Thereafter, at least one or more layers containing silver bromide or silver iodobromide (hereinafter called a shell layer) are formed.

When a seed crystal is used, it is allowed either to form silver iodide of at least 20 mol% or more in the seed crystal and then to coat the seed crystal with a shell layer or to contain silver iodide in an amount within the range of from zero to 10 mol% in the seed crystal so as to form silver iodide of at least 20 mol% within the grain in the course of growing the seed crystal and then to coat the seed crystal with a shell layer.

Provided that a proportion of silver iodide is within the range of from 0.5 to 10 mol% to every silver halide used in all the grains, the seed crystal becomes larger in size and the grain-size distribution becomes broader in the former process than in the latter process. It is, therefore, preferable in the invention to use such a grain having a multi-layered structure as those used in the latter process, because a monodisperse type emulsion may readily be prepared therein.

In addition to the above, as for the processes for forming a layer having a localized part, a halogen-substitution process may be used. Such a halogen-substitution process may be carried out, for example, in such a manner that an inner core is formed and an aqueous solution of an iodide compound is then added. To be more concrete, this type of processes may be performed in the processes described in detail in U.S. Pat. Nos. 2,592,250 and 4,075,020, Japanese Patent O.P.I. Publication No. 127549/1980 and the like.

When using a monodisperse type emulsion, such a sensitization as a chemical sensitization may satisfactorily be so applied as to obtain a remarkably high sensitivity and a contrast may not much be reduced even in such a sensitization process, so that the contrast may be hardened.

The above-mentioned monodisperse type emulsion may be prepared in such a manner that the crystal growth of emulsion grains are carried out first, and when growing the grains, it is allowed to add silver ions and a halide solution alternately in a time series, and it is, however, preferred to use the so-called double-jet process.

In the case of supplying the silver ions and halide ions, either a critical growth rate is to be applied so as not to dissolve the existing crystal grains away and conversely not to allow any formation or growth of new grains and further to supply a satisfactory amount of a silver halide necessary for growing only the existing grains, or a growth rate is to be gradually increased continuously or stepwise within the allowable range, as the crystal grains are being grown. How to gradually increasing the rate is described in, for example, Japanese Patent Examined Publication Nos. 36890/1973 or 16364/1977, or Japanese Patent O.P.I. Publication No. 142329/1980.

The above-mentioned critical growth rate is varied according to a temperature, pH value, pAg value, stirring frequency, silver halide grain composition, solubility, agrain-size, intergrain distance, crystal habit or kind of protective colloids and the concentration thereof, and the like. However, the critical growth rates may readily be obtained in such an experimental way as a microscopic observation or turbidity measurement of emulsion grains being suspended in a liquid phase.

In order to obtain the above-mentioned monodisperse type emulsion, it is preferred that such grain is to be grown by using the seed crystal to serve as the growing nucleus and supplying thereto silver ions and halide ions.

The broader the grain-size distribution of the above-mentioned seed crystal is, the broader the grain-size distribution thereof is, after the grains are grown up. Accordingly, it is preferred to use such a grain as is narrow in the grain-size distribution in the stage of the seed crystal, so as to obtain the monodisperse type emulsion.

In practicing this invention, the silver halide grains to be used in the silver halide emulsion may be prepared by the application of any of those neutral method, acid method, ammoniacal method, orderly mixing method, inverse mixing method, double-jet method, controlled double-jet method, conversion method, core/shell method, and the like, as described in, e.g., T. H. James, The Theory of the Photographic Process, 4th ed., published by MacMillan (1977) p. 38–104, and the like.

Such silver halide grains or such a silver halide emulsion is desirable to contain at least one of those salts (water-soluble salts) of iridium, thalium, palladium, rhodium, zinc, nickel, cobalt, uranium, thorium, strontium, tungsten and platinum. The salt content of the emulsion is preferably from $10^{-1}$ to $10^{-6}$ per mole of silver, and more preferably the emulsion contains at least one of those salts of thalium, palladium and iridium. These salts may be used alone or in a mixture, and the adding stage (adding point of time) thereof is discretional. The grains each may also be endowed thereinside with a reduction sensitization nucleus by making use of a suitable reducing agent or under a relatively lower pAg atmosphere.

By doing this, the improvement of the flash exposure characteristics, prevention of the pressure desensitization, prevention of the latent image fading, sensitization and other effects can be expected. Silver halide grains may be made more finer in size, provided that a sensitivity of an optically sensitized light-sensitive material may be kept in the same level as that before it is sensitized. It is, therefore, possible to obtain the light-sensitive materials excellent in image quality, pressure resistance and the like.

The term 'average grain size r' used herein means the average value, in the case of spherical silver halide grains, of the diameters thereof and, in the case of cubic grains, of the lengths of the sides thereof and, in the case of other forms, of the diameters of assumed circular images corresponding in the area to the projected images thereof. When each individual grain size is regarded as $r_i$ and the number of the grains as $n_i$, the average grain size r is defined by the following equation:

$$\bar{r} = \frac{\Sigma n_i r_i}{\Sigma n_i}$$

As for the monodisperse silver halide (grains) in this invention, when the silver halide grain size distribution's standard deviation S as defined by the following equation is divided by the average grain size r, the quotient is desirable to be not more than 0.20.

$$S = \sqrt{\frac{\Sigma (\bar{r} - r_i)^2 n_i}{\Sigma n_i}}$$

$$\frac{S}{\bar{r}} \leqq 0.20$$

Further, the $S/\bar{r}$ is more desirable to be equal to or less than 0.15.

In a silver halide emulsion used in the invention, it is usual that the furfaces of the grains thereof are chemically sensitized. As for the chemical sensitization processes, a sulfur sensitization process using a compound containing sulfur capable of reacting with silver ions and an active gelatin, a reduction sensitization process using a reducible substance, a noble metal sensitization process using gold or other noble metal compounds, and the like may be used independently or in combination. The sulfur sensitizers useful therein include, for example, a thiosulfate, a thiourea, a thiazole, a rhodanine and other compounds. The reduction sensitizers useful therein include, for example, a stannous salt, an amine, a hydrazine derivative, a formamidinesulfinic acid, a silane compound and the like. The noble metal sensitizers useful therein include, for example, such a metal complex which belongs to the VIII group of the periodic table, such as the complex salts of platinum, iridium or palladium, as well as the complex salts of gold.

A photosensitive layer containing the above-mentioned grains is to be present on at least one side of a support.

The silver halide photographic light-sensitive material of this invention is desirable to be sensitized by a gold sensitizer in a quantity of from $1.0\times10^{-16}$ to $1.0\times10^{-20}$ moles per $\mu m^2$ of the surface area of the silver halide grain. By doing this, a high-speed light-sensitive material excellent in the preservability and producing little or no fog due to a safelight can be obtained. This effect is significant also in a color-sensitized silver halide emulsion.

The surface area of the silver halide grain, if the average grain size is regarded as r, where the grain is in the form of a cube, can be calculated by $6\times r^2$, and where the grain is in the spherical form, can be calculated by $\pi r^2$ (the average grain size r will be defined hereinafter). The foregoing gold sensitizer is desirable to be used in the above quantity per unit area of the surface area of such the grain.

As for the gold sensitizer, those various gold compounds known as gold sensitizers may be used, which include, for example, chloroaurates, gold chloride, gold thiocyanate, etc., which is advantageously usable. And those compounds as described in U.S. Pat. No. 2,399,083 may also be used.

In practicing this invention, gold sensitizers and other sensitizing means may be used in combination. For example, sulfur sensitizers may be used in combination with gold sensitizers, i.e., gold-sulfur sensitization may be suitably used.

In this case, as for the sulfur sensitizer, those various inorganic and organic compounds known as sulfur sensitizers may be used, which include, e.g., thiosulfates, thiourea, allylthiourea, allylisothiocyanate, and the like. And those compounds as disclosed in U.S. Pat. No. 1,623,499 may also be used.

In addition, the gold-sulfur sensitization is desirable to be made in the presence of a thiocyanate.

In combination with the gol-sulfur sensitization, reduction sensitization which uses thiourea dioxide, stannous chloride, silver ripening, etc. and selenium sensitization, and the like may be used. In the case of using a sulfur sensitizer, in order to have it exhibit adequately the effect of this invention for improving the preservability and prevention of the safelight fog, the sulfur sensitizer should be used in the using quantity range of from $1.0\times10^{-13}$ to $1.0\times10^{-19}$ moles per unit surface area ($\mu m^2$) of silver halide.

The molar ratio in the adding quantity between the sulfur sensitizer and the gold sensitizer is preferably from 10:1 to 1:1, and more preferably from 7:1 to 5:1.

Such a silver halide emulsion as described above is suitable for preparing a photographic light-sensitive material for radiographic use capable of displaying the preferable characteristics as mentioned below.

Namely, the silver halide photographic light-sensitive material for radiography use in the medical field is desired to be excellent in the depictability also for the early detection of focuses as well as for the prevention of errosneous diagnoses. The optical density range used for diagnoses is normally from 0.05 to 1.5, and in a range exceeding the exposure range, the detail in the shadow area becomes obscure to deteriorate the detection. That is, the most important characteristic which a silver halide photographic light-sensitive material for medical radiography use should have is to be excellent in the depictability in the optical density range of from 0.05 to 1.5.

The depictability depends on the quantity of information and image quality. And the quantity of information is determined by the exposure range, and the image quantity by the graininess and sharpness.

Therefore, the preferred silver halide photographic light-sensitive material for medical radiography use shall be one capable of satisfying all the requirements: the desirable graininess and sharpness and wide exposure range in terms of the optical density range of from 0.05 to 1.5.

The photographic characteristics of the high density area of the silver halide photographic light-sensitive material for radiography use differ according to the region of the human body to be radiographed. For example, a contrast medium is used in high X-ray-transmittance regions including digestive organs such as the stomach. If a radiographic exposure adjusted to the contrast medium region is used, nothing but a fill-in image is obtained, thus being unable to contribute to diagnosis. However, if the photographic light-sensitive material is of a low gamma, this can be avoided.

And where a high gamma is required for the medium density region as in the angiography, if the gamma in the high-density area is also raised, this can be avoided also.

From the point of view as described above, the photographic light-sensitive materials for radiographic use are particularly preferred to endow with the following $\gamma$ characteristics.

On the characteristic curve thereof drawn on a rectangular coordinate system with the equal unit length-graduated coordinate axes for optical density (D) and for exposure (log E), gamma ($\gamma_1$) formed between the point of an optical density of 0.05 and the point of an optical density of 0.30 is from 0.50 to 1.00, and gamma ($\gamma_2$) formed between the point of an optical density of 0.50 and the point of an optical density of 1.5 on the characteristic curve is from 2.5 to 3.5.

The gamma herein means one obtained on the basis of a characteristic curve formed on rectangular coordinates of optical density (D) and logarithm of exposure (log E) whose coordinate axes' unit length is equally taken. The $\gamma_1$ means the inclination of the straight line formed by connecting the density point consisting of the base (support) density+fog density+0.05 on the characteristic curve with another density point consisting of the base density+fog density+0.30 on the same characteristic curve, and the $\gamma_2$ means the inclination of the straight line formed by connecting the density point consisting of the base density+fog density+0.50 with another density point consisting of the base density+-fog density+1.50. Further, to express numerically, if the angles formed by these straight lines and the exposure axis (axis of abscissa) intersecting each other are regarded as $\theta_1$ and $\theta_2$, respectively, then the $\gamma_1$ and $\gamma_2$ mean tan $\theta_1$ and tan $\theta_2$, respectively.

The particularly preferred embodiment is such that the above $\gamma_1$ and $\gamma_2$ are obtained on the characteristic curve on rectangular coordinates when processing is carried out under the following processing conditions:

PROCESSING CONDITIONS

Processing is made with use of the following developer-1 in a roller transport-type automatic processor in accordance with the following processing steps:

| | Temperature | processing time |
|---|---|---|
| Developing | 35° C. | 30 seconds |
| Fixing | 34° C. | 20 seconds |
| Washing | 33° C. | 18 seconds |
| Drying | 45° C. | 22 seconds |

| Developer-1 | |
|---|---|
| Potassium sulfite | 55.0 g |
| Hydroquinone | 25.0 g |
| 1-phenyl-3-pyrazolidone | 1.2 g |
| Boric acid | 10.0 g |
| Potassium hydroxide | 21.0 g |
| Triethylene glycol | 17.5 g |
| 5-methylbenzotriazole | 0.04 g |
| 5-nitrobenzimidazole | 0.11 g |
| 1-phenyl-5-mercaptotetrazole | 0.015 g |
| Glutaraldehyde hydrogensulfite | 15.0 g |
| Glacial acetic acid | 16.0 g |
| Potassium bromide | 4.0 g |
| Water to make 1 liter. | |

Such the characteristic curve can be obtained, for example, by the following photosensitometry: Speaking of a light-sensitive material for radiography use, a light-sensitive material for radiography use comprising a transparent support having an emulsion layer on one side thereof or emulsion layers on both sides thereof is placed between a pair of optical wedges whose density inclination is mirror-symmetrically arranged, and both sides of the light-sensitive material are exposed equally simultaneously for 1/10 second to light sources of a color temperature of 5,400° K. arranged on both opposite sides. The processing of the light-sensitive material is carried out in accordance with the foregoing steps in a roller transport-type automatic processor. A fixer solution to be used is not particularly restricted as long as it is an acid hardening fixer solution; for example, Sakura FX (product of Konishiroku Photo Industry Co., Ltd.) or the like may be used.

The silver halide photographic light-sentive material of this invention, which shows a characteristic curve whose $\gamma_1$ and $\gamma_2$ are in the above range, has so high sharpness and so satisfactory graininess that all the regions of the human body can be satisfactorily radiographed and also has so wide latitudes in the low and high density areas that diagnoses can be advantageously conducted.

It is more desirable that $\gamma_1$ be from 0.60 to 0.90 and $\gamma_2$ be from 2.6 to 3.4.

Subsequently, the preparation of the silver halide photographic light-sensitive material having a characteristic curve whose $\gamma_1$ and $\gamma_2$ are in the range of this invention will be illustrated below:

In practicing this invention, a silver halide emulsion prepared by mixing large-size silver halide grains, medium-size silver halide grains and small-size silver halide grains can be used. For example, the preparation is made by mixing properly chemically sensitized grains of three different average sizes of 0.95$\mu$, 0.75$\mu$ and 0.55$\mu$ in a proportion by weight of silver halide of (10–40):(30–80):(10–40), and preferably (15–30):(-40–70):(15–30).

In the present invention, the granularity distribution of the whole silver halide grains of the light-sensitive material is desirable to comprise at least two peaks and dales. Such peaks and dales, because the large(medium)-size and small-size grains have their independent granularity distributions, can be formed by the mixing. In the peak modes, the interval between the highest peak mode and the peak mode adjacent thereto is desirable to be from 0.10 $\mu$m to 0.40 $\mu$m.

Also, in this invention, as for the form of the granularity distribution curve, when the grain size in the dale formed between the foregoing highest peak mode A($\mu$) and the peak mode B($\mu$) adjacent thereto (if there are two adjacent peaks, the higher one of them) is regarded as C($\mu$), the frequency of the C is preferably from 90% to 5%, and more preferably from 80% to 10% (for A, B and C, see the example shown in FIG. 1). There are cases where no very satisfactory effects can be obtained in respect of the sharpness in the form of the characteristic curve if this ratio is less than 5%, and in respect of the sensitivity if the ratio exceeds 90%.

The proportion of the highest peak mode A to the peak mode B is preferably from 1:1 to 1:0.3, and more preferably from 1:0.9 to 1:0.4. If this proportion is too small, the mixing will mean little. As long as the proportion is in the above range, good results can be attained. Where the highest peak mode is a mode of small grains, if the proportion is smaller and the ratio of large-size grains is reduced, the sensitivity may be lowered. And where the highest peak mode is a mode of small grains, if the peak mode of large-size grains is extremely close to the peak mode of small-size grains, the sharpness of the high density area may be deteriorated. On the other hand, where the highest peak mode is a mode of large-size grains, if the proportion is smaller and the ratio of small-size grains is reduced, the improvement on the maximum density attributable to small-size grains may not be expected. Also, where the highest peak mode is a mode of large-size grains, if the mode of small-size grains is close to the mode of large-size grains, the sensitivity may be lowered or the sharpness in the medium density area may be deteriorated. If the above proportion falls under the range of from 1:1 to 1:0.3 or from 1:0.9 to 1:0.4, in any case good effects can be adequately displayed.

In practicing this invention, when discriminating between the modes like this, the different silver halide grains as such may be used either together in a single layer or separately in two or more layers to have these layers attain the above modes as a whole. For example, where two layers, a high-speed layer and a low-speed layer, are provided, the two layers may be so constructed as to have the above-described mode differential as a whole.

In the present invention, the obtaining of a silver halide photographic light-sensitive material of a characteristic curve whose high-density portion is of a low-gamma type can be carried out by reducing the ratio of small-size silver halide grains or by minimizing the grain size of small-size silver halide grains, and further by increasing the hardness of the emulsion with use of a large quantity of a hardener. Increasing the hardening is useful means for making the gamma of the high-density portion of the characteristic curve lower than that of the medium-density portion.

Lowering the gamma of the high-density portion of the characteristic curve can be attained also by preferentially softening the high-density portion of the curve by means of adding a certain development restrainer to the emulsion. There are various additives usable as the hardener or the development restrainer.

The gamma of the low-gamma-type silver halide emulsion is desirable to be from 0.7 to 1.4 with an optical density of from 2.0 to 2.6. The preferred grain size mixing proportion by weight of silver halide grains of 0.95μ:0.75μ:0.40μ in the low-gamma-type silver halide emulsion should be (20–60):(30–60):(5–25).

The grain size of the silver halide grains is further desirable to be from 0.1 to 3.0μ. In practicing this invention, as has been described above, the silver halide grains are desirable to be of a grain size distribution curve having preferably peaks and dales, and more preferably two or more peaks, the interval between the highest peak mode (e.g., A of FIG. 2) and the peak mode adjacent thereto (e.g., B of FIG. 2) of which is not less than 0.10μ and not more than 0.40μ.

If the above construction is taken, the sensitivity can be raised by the grains whose mode (most frequent value) in the grain-size distribution curve is large, i.e., by the group of large-size silver halide grains, while the covering power can be raised by the grains whose mode in the grain-size distribution curve is small, i.e., the group of small-size silver halide grains.

Particularly, the above-mentioned interval is desirable to be from 0.15μ to 0.37μ.

In the present invention, where two or more silver halide emulsions different in the average grain size are to be used, the compositions of these emulsions may be either the same as or different from each other.

To the silver halide grain of this invention, in the course of the growth thereof, may be added noble metallic ions such as of Ir, Rh, Pt, Au, etc., to be incorporated inside the grain, and inside the grain may be provided a reduction sensitization nucleus by using a low pAg atmosphere or an appropriate reducing agent. And if the sensitivity of an optically sensitized light-sensitive material is restrained to be kept on the same level as that of the one before being sensitized, the silver halide grains of the light-sensitive material can be very fine-grained, so that a light-sensitive material excellent in the image quality as well as in the resistance against pressure can be obtained.

In the silver halide photographic light-sensitive material of this invention, the emulsion thereof can be optically sensitized. No particular restrictions are put on those for use in optical sensitization. For example, those various optical sensitizers to be generally used for the optical sensitization of ordinary silver halide emulsions, such as cyanine dyes, merocyanine dyes, and the like may be used, however, the silver halide photographic light-sensitive material of this invention is particularly desirable to have at least one emulsion layer containing at least one compound selected from the group of compounds having the following general formulas [I], [II] and [III]:

Formula [I]

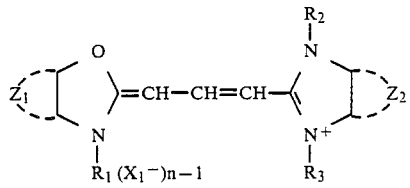

wherein $R_1$, $R_2$ and $R_3$ each is a substituted or unsubstituted alkyl, alkenyl or aryl group, provided that at least one of the $R_1$ and $R_3$ is a sulfoalkyl or carboxyalkyl group; $X_1^-$ is an anion; $Z_1$ and $Z_2$ each is a group of nonmetallic atoms necessary to complete a substituted or unsubstituted benzene ring; and n is 1 or 2, provided that n is 1 when an intramolecular salt is formed.

Formula [II]

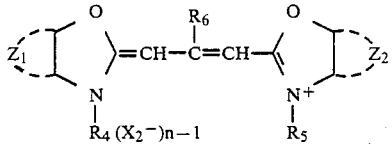

wherein $R_4$ and $R_5$ each is a substituted or unsubstituted alkyl, alkenyl or aryl group, provided that the either one of the $R_4$ and $R_5$ is a sulfoalkyl or carboxyalkyl group; $R_6$ is a hydrogen atom, a lower alkyl or aryl group; $X_2^-$ is an anion; $Z_1$ and $Z_2$ each is a group of nonmetallic atoms necessary to complete a substituted or unsubstituted benzene ring; and n is 1 or 2, provided that n is 1 when an intramolecular salt is formed.

Formula [III]

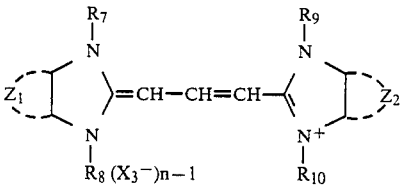

wherein $R_7$ and $R_9$ each is a substituted or unsubstituted lower alkyl group; $R_8$ and $R_{10}$ each is a lower alkyl, hydroxyalkyl, sulfoalkyl or carboxyalkyl group; $X_3^-$ is an anion; $Z_1$ and $Z_2$ each is a group of nonmetallic atoms necessary to complete a substituted or unsubstituted benzene ring; and n is 1 or 2, provided that n is 1 when an intramolecular salt is formed).

In Formula [I], those anions represented by the $X_1$ include, e.g., chlorine ion, bromine ion, iodine ion, thiocyanic acid ion, sulfuric acid ion, perchloric acid ion, p-toluenesulfonic acid ion, ethylsulfonic acid ion, and the like.

The following are examples representative of the compounds having Formula [I], but the present invention is not limited thereto.

[Exemplified Compounds]

(1)

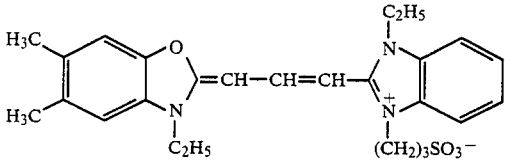

(2)

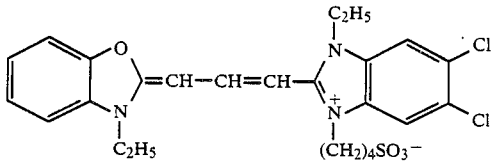

(3)

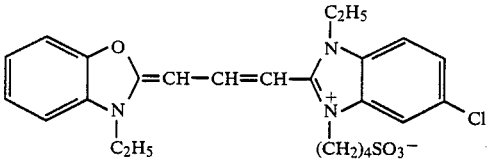

(4)

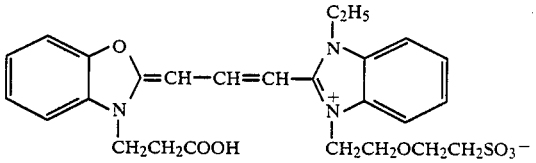

(5)

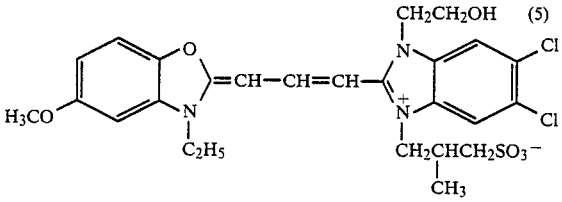

(6)

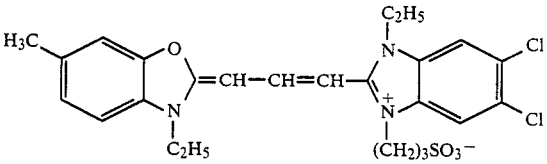

(7)

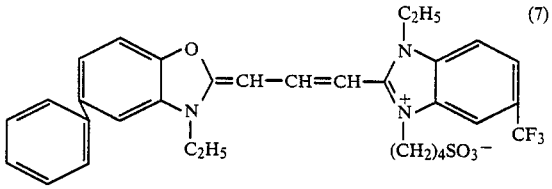

(8)

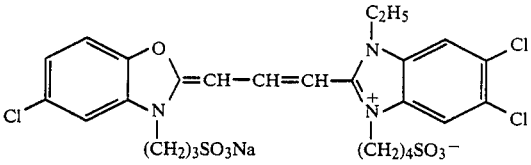

(9)

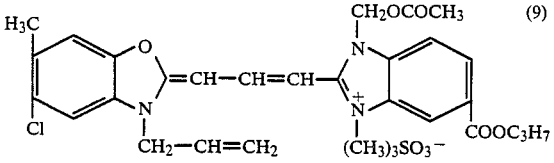

(10)

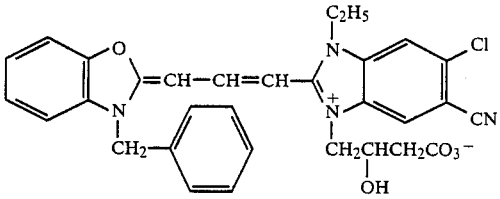

(11)

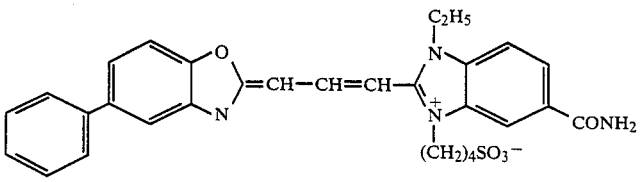

(12)

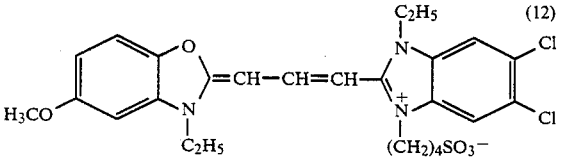

(13)

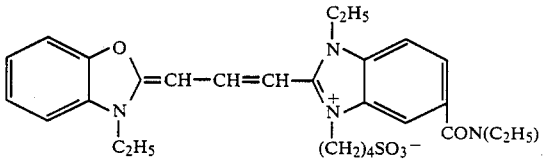

-continued
(14)
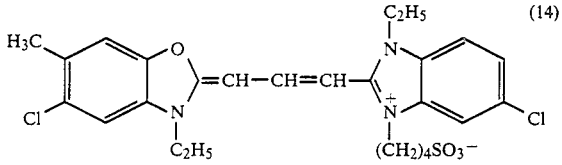
(15)
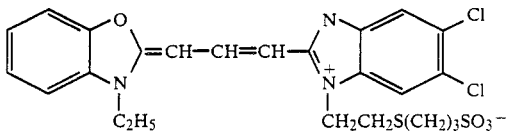
(16)
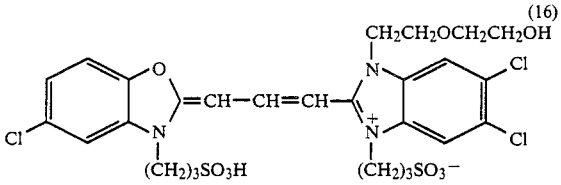
(17)
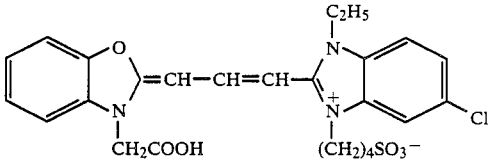
(18)
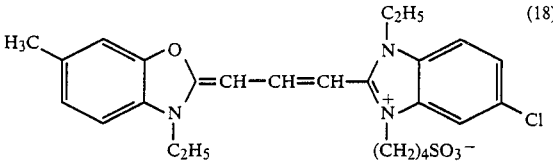
(19)
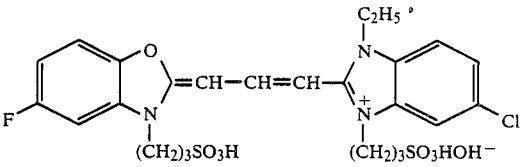
(20)
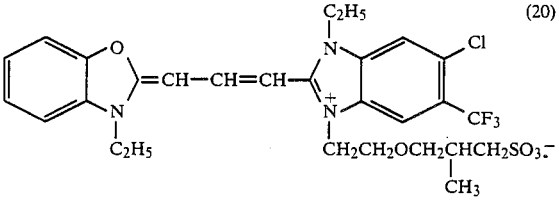
(21)
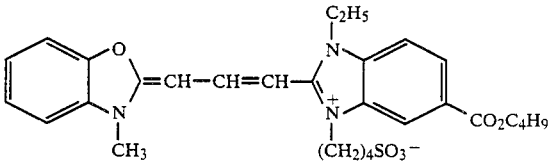
(22)
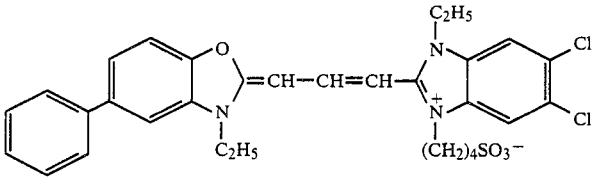
(23)
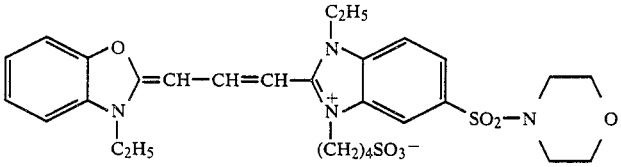
(24)
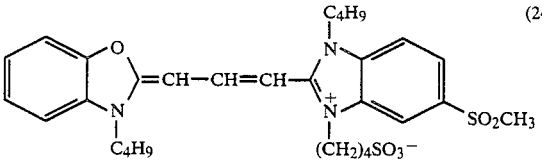
(25)
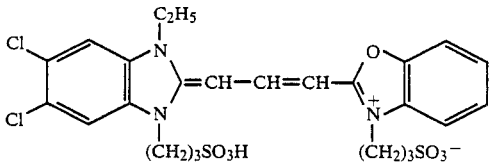
(26)
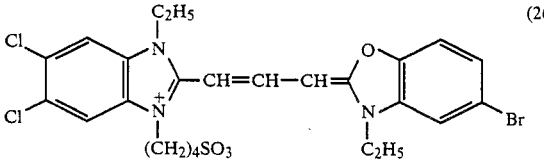
(27)
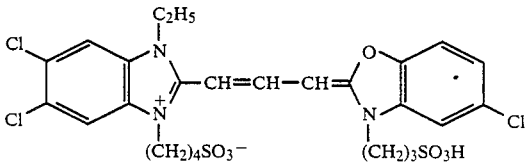
(28)
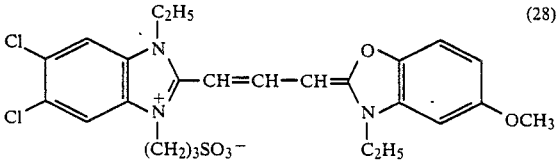
(29)
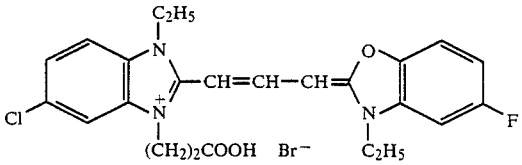

-continued
(30)
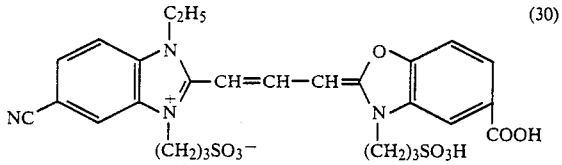
(31)
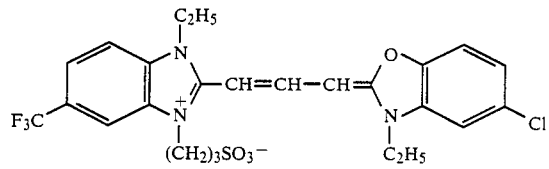
(32)
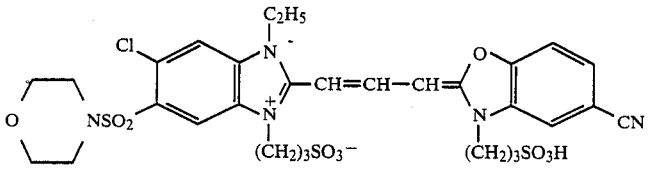
(33)
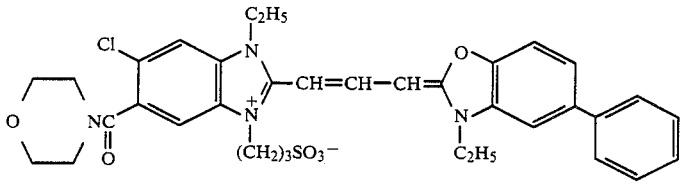
(34)
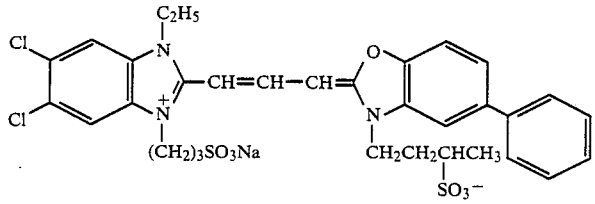
(35)
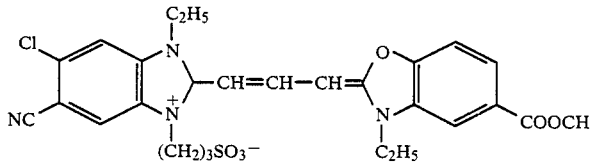
(36)
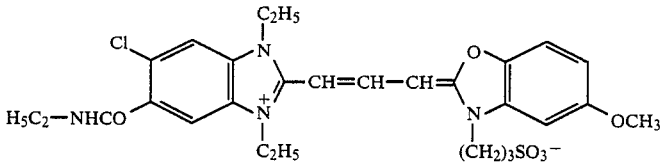
(37)
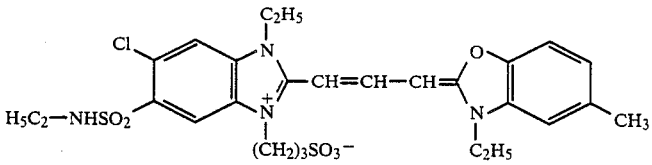
(38)
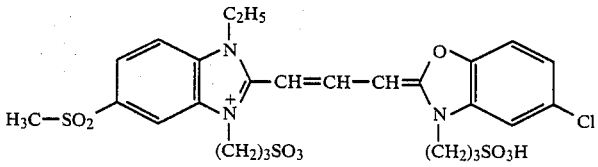
(39)
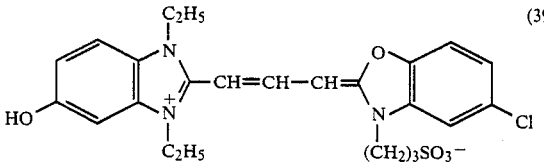
(40)
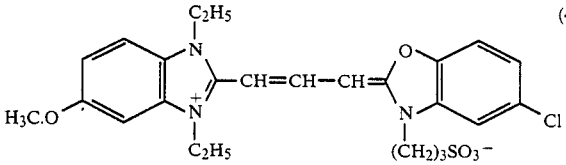

-continued (41)

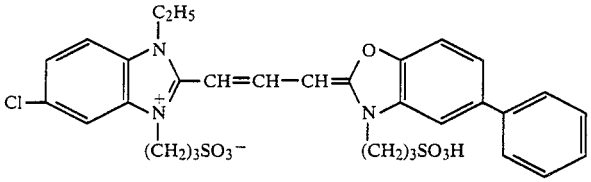

In Formula [II], the $R_6$ represents a hydrogen atom, a lower alkyl or aryl group. Examples of the lower alkyl group include methyl, ethyl, propyl, butyl and the like groups. Examples of the aryl group include, e.g., phenyl group. Examples represented by each of the $R_4$ and $R_5$ include those as defined in the $R_1$ and $R_3$ of the foregoing Formula [I]. Examples of the anion represented by the $X_2^-$ also include those as defined in the $X_1^-$ of Formula [I].

Subsequently, the following are examples representative of the compounds having Formula [II], but it goes without saying that the present invention is not limited thereto.

(42)

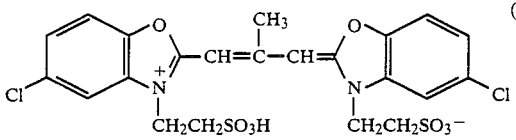

(43)

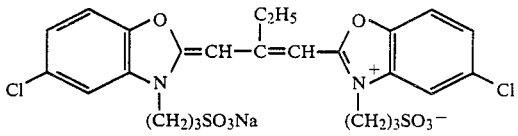

(44)

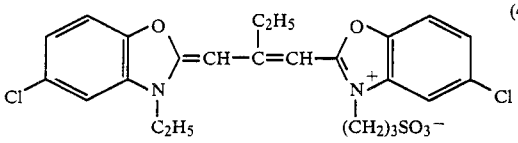

(45)

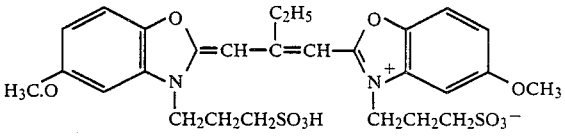

(46)

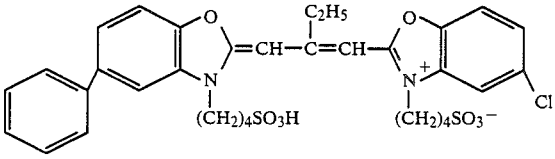

(47)

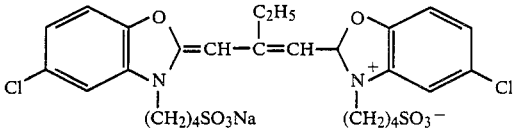

(48)

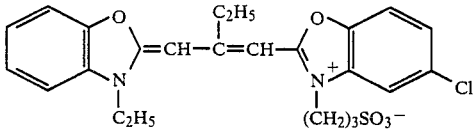

(49)

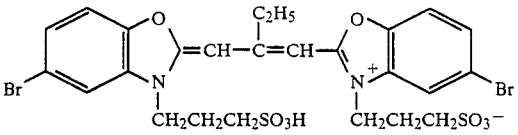

(50)

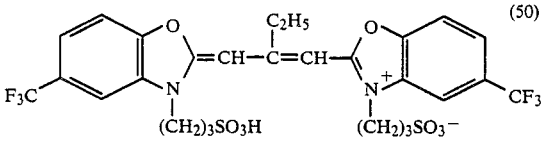

(51)

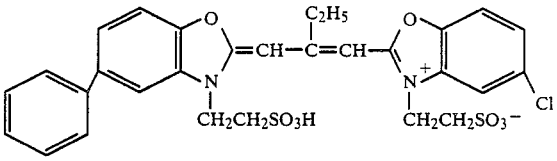

(52)

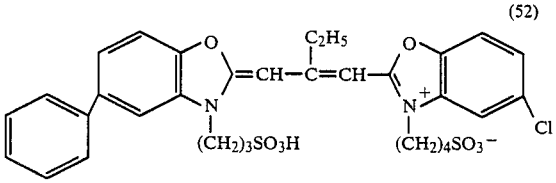

(53)

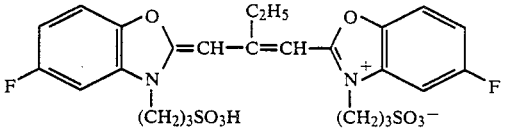

(54)

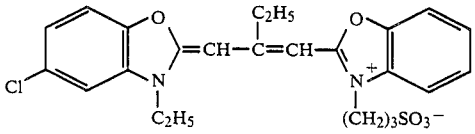

(55)

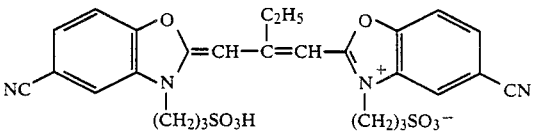

-continued (56)

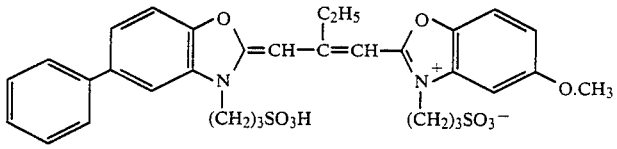

(57)

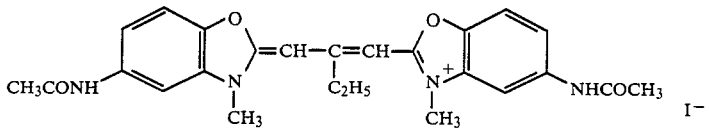

(58)

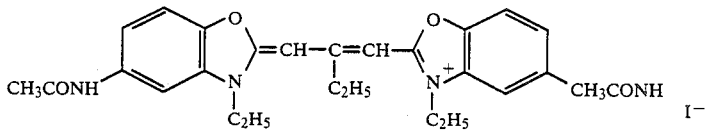

(59)

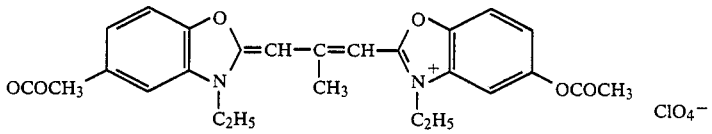

(60)

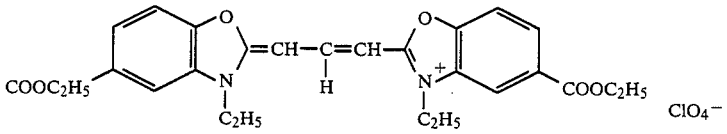

(61)

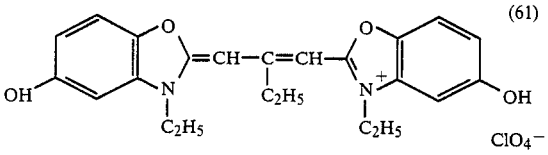

(62)

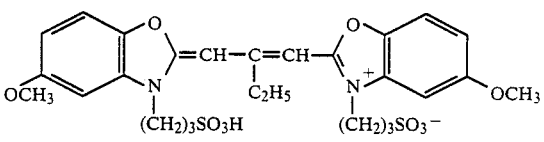

(63)

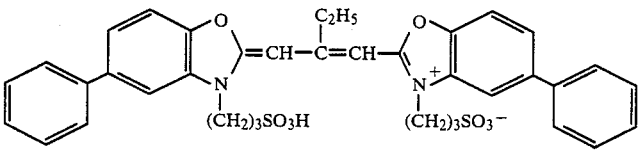

(64)

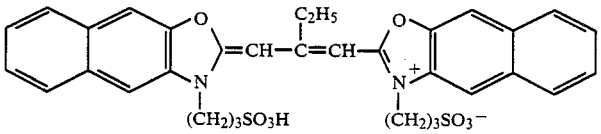

In Formula [III], examples of the lower alkyl represented by each of the $R_7$ and $R_9$ include methyl, ethyl, propyl, butyl and the like groups. Examples of the substituted alkyl include those groups as defined in the $R_1$ to $R_3$ of the foregoing Formula [I]. Examples of the lower alkyl group represented by each of the $R_8$ and $R_{10}$ include those groups as defined in the $R_7$ and $R_9$. Examples of the hydroxyalkyl, sulfoalkyl and carboxyalkyl groups represented by each of the $R_8$ and $R_{10}$ include those groups as defined in the $R_1$ through $R_3$ of Formula [I].

Examples of the anion represented by $X_3^-$ also include those as defined in the $X_1^-$ of Formula [I].

The following are examples representative of the compounds having Formula [III], but it goes without saying that the present invention is not limited thereto.

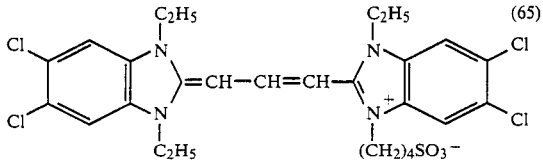
(65)

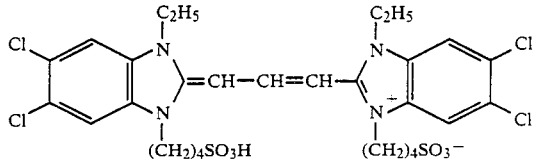
(66)

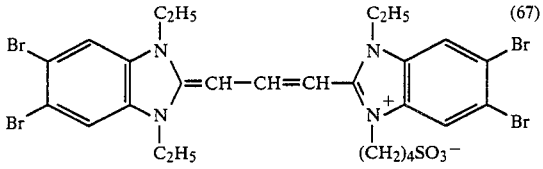
(67)

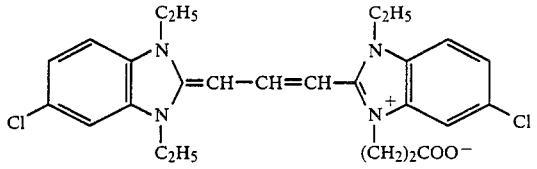
(68)

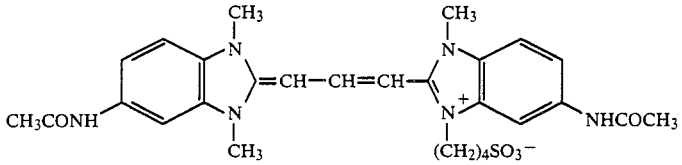
(69)

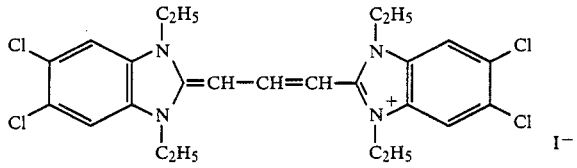
(70)

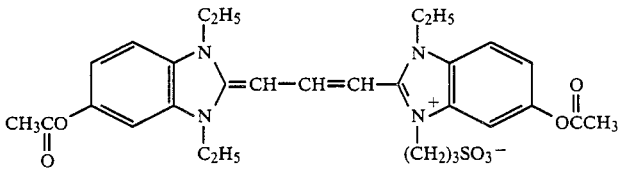
(71)

The total adding amount of these compounds having Formulas [I], [II] and [III] to be used is in the range of preferably from 10 to 900 mg, and particularly preferably from 60 to 600 mg per Ag 1 mol.

As the hydrophilic colloid for use in dispersing the silver halide grains relating to this invention, gelatin is most suitable. Further, in order to improve the binder's physical characteristics, for example, gelatin derivatives; other natural hydrophilic colloids such as albumin, casein, agar-agar, gum arabic, etc.; alginic acid and derivatives thereof such as salts, amides and esters thereof; starch and derivatives thereof; cellulose derivatives such as cellulose ethers, partially hydrolyzed cellulose acetate, carboxymethyl cellulose, etc.; synthetic hydrophilic resins such as polyvinyl alcohol, polyvinyl pyrolidone; acrylic acid and methacrylic acid and derivatives thereof such as homo- and co-polymers of esters or amides thereof with nitriles; vinyl polymers such as vinyl ethers, vinyl esters, etc.; and the like, may also be used.

In conducting a rapid processing by an automatic processor, the amount of gelatin in the silver halide photographic light-sensitive material is desirable to be as small as possible for improving the drying rate. On the other hand, however, when the amount of gelatin is reduced, its effect as a protective colloid is lowered, whereby pressure marks tend to appear on the light-sensitive material in transit by roller transport. Accordingly, the proportion by weight of the amount of gelatin to be used in the silver halide photographic light-sensitive material of this invention to the amount of the silver of the silver halide of the same (amount of gelatin/amount of silver) is desirable to be from 0.4 to 0.8.

Compounds usable as the stabilizer and antifoggant for the silver halide photographic light-sensitive material of this invention include those stabilizers and antifoggants as described in, e.g., U.S. Pat. Nos. 2,444,607, 2,716,062, 3,512,982 and 3,342,596, West German Pat. Nos. 1,189,380, 205,862 and 211,841, Japanese Patent Examined Publication Nos. 4183/1968 and 2825/1964, Japanese Patent O.P.I. Publication Nos. 22626/1975 and 25218/1975, and the like. Among them the particularly preferred compounds are 4-hydroxy-6-methyl-1,3,3a,7-tetrazaindene, 5,6-trimethylene-7-hydroxy-S-triazo(1,5-a)pyrimidine, 5,6-tetramethylene-7-hydroxy-S-triazolo(1,5-a)pyrimidine, 5-methyl-7-hydroxy-S-triazolo(1,5-a)pyrimidine, 7-hydroxy-S-triazolo(1,5-a)pyrimidine, gallates (such as isoamyl gallate, dodecyl gallate, propyl gallate, sodium gallate, etc.), mercaptans (such as 1-phenyl-5-mercaptotetrazole, 2-mercaptobenzothiazole, etc.), benzotriazoles (such as 5-bromobenzotriazole, 4-methylbenzotriazole, etc.), benzimidazoles (such as 6-nitrobenzimidazole), and the like. In addition, as the antifoggant the nitron described in Japanese Patent Examined Publication may also be used.

The silver halide color photographic light-sensitive material of this invention may contain in the coating liquid thereof any one of photographic hardeners generally used in ordinary light-sensitive materials, which include, e.g., those aldehyde-type and aziridine-type compounds (as described in PB Report No. 19,921, U.S. Pat. Nos. 2,950,197, 2,964,404, 2,983,611 and 3,271,175, Japanese Patent Examined Publication No. 40898/1971, and Japanese Patent O.P.I. Publication No. 91315/1975), those isooxazole-type compounds (as described in U.S. Pat. No. 331,609), those epoxi-type compounds (as described in U.S. Pat. No. 3,047,394, West German Pat. No. 1,085,663, British Pat. No. 1,033,518, and Japanese Patent Examined Publication No. 35495/1973), those vinylsulfone-type compounds (as described in PB Report No. 19,920, West German Pat. No. 1,100,942, British Pat. No. 1,251,091, Japanese Patent Application Nos. 54236/1970 and 110996/1973, and U.S. Pat. Nos. 353,964 and 3,490,911), those acryloyl-type compounds (as described in Japanese Patent Application No. 27949/1973, and U.S. Pat. No. 3,640,720), those carbodiimide-type compounds (as described in U.S. Pat. No. 2,938,892, Japanese Patent Examined Publication No. 38715/1971, Japanese Patent Application No. 15095/1974). And others such as maleimide-type, acetylene-type, methanesulfonic acid ester-type, triazine-type and high-molecular-type hardeners may also be used.

Useful examples of the high-molecular-type hardener include those described in, e.g., Japanese Patent O.P.I. Publication No. 66841/1981, British Pat. No. 1,322,971, U.S. Pat. No. 3,671,256, Japanese Patent O.P.I. Publication No. 112034/1985, and also those high-molecular hardeners having a functional group capable of reacting with gelatin as described in D. M. Burness, J. Pouradier, 'The Theory of the Photographic Process' 4th ed: 8 T. H. James ed., MacMillan, New York, 1977, p. 84; and G. A. Campbell, L. R. Hamilton, I. S. Ponticello, 'Polymeric Amine and Ammonium Salts' (E. J. Goethals ed.) Pergamon Press, New York, 1979, p. 321–332.

Particularly preferred high-molecular hardeners are those compounds having the following general formula:

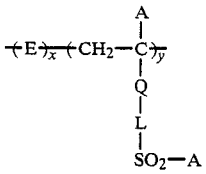

wherein

E is an ethylenic unsaturated monomer which is copolymerizable with the monomer unit at right in the formula; and A is a hydrogen atom or a lower alkyl group having from 1 to 6 carbon atoms;

Q is a $-CO_2-$,

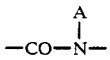

(wherein A is as defined above) or an arylene group having from 6 to 10 carbon atoms;

L is a divalent group having from 3 to 15 carbon atoms, containing at least one of the $-CO_2-$ and

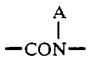

(wherein A is as defined above), or a divalent group having from 1 to 12 carbon atoms, containing at least one of —O—, —N—, —CO—, —SO—, $-SO_2-$, $-SO_3-$,

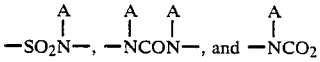

(wherein A is as defined above); A′ is a vinyl group or a functional group as the precursor thereof and represents $-CH{=}CH_2$ or $-CH_2CH_2X'$, wherein X′ is a group substitutable by a nucleophilic group or a group splittable in the form of HX′ by a base; and x and y each represents a molar percentage, wherein x takes a value of from zero up to 90, and y takes a value of from 1 to 100.

And, as the viscosity-increasing agent for the light-sensitive material of this invention those as described in, e.g., U.S. Pat. No. 3,167,410, and Belgian Pat. No. 558,143, as the gelatin plasticizer those polyols as described in U.S. Pat. No. 2,960,404, Japanese Patent Examined Publication No. 4939/1968, and Japanese Patent O.P.I. Publication No. 63715/1973, as the latexes those as described in U.S. Pat. No. 766,979, French Pat. No. 1,395,544, and Japanese Patent Examined Publication No. 43125/1973, and as the matting agent those as described in British Pat. No. 1,221,980, and the like may be used.

The silver halide photographic light-semsitive material for radiography use of this invention may contain in the component elements thereof a desired coating aid. For example, saponin or those sulfosuccinic acid-type surfactants as described in, e.g., British Pat. No. 548,532, Japanese Patent Application No. 89630/1972, etc., or those anionic surfactants as described in, e.g., Japanese Patent Examined Publication No. 18166/1968, U.S. Pat. No. 3,514,239, French Pat. No. 2,025,688, Japanese Patent Examined Publication No. 10247/1968, and the like, may be used.

It is known that a light-sensitive material can be improved on the sharpness thereof for green and blue regions by adding magenta and yellow dyes, respectively, thereto.

The magenta dye is of the maximum absorption wavelength of from 500 to 600 nm, and the yellow dye is of the maximum absorption wavelength of from 400 to 500 nm.

Any dyes showing such the absorption maximum range of from 400 nm to 600 nm can be used as long as their absorption range has complementary color relations with the emission light spectrum of the phosphor to be used with the light-sensitive material used in the practice of this invention. Particularly, such dyes are desirable to be ones discolored or changed into the same color as that of the support during the processing of the light-sensitive material.

The following are examples of the dyes suitably usable in this invention:

[Exemplified Compounds]
a
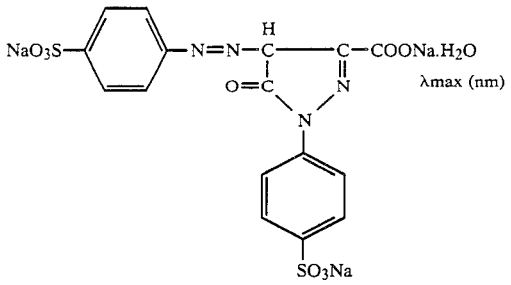
λmax (nm) 430
b
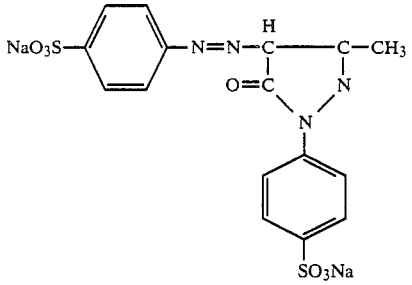
402
c
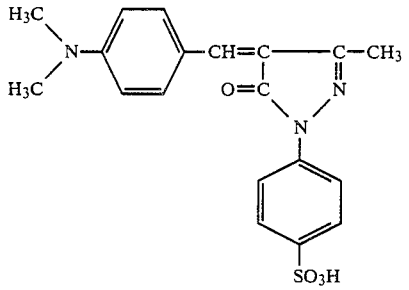
510
d
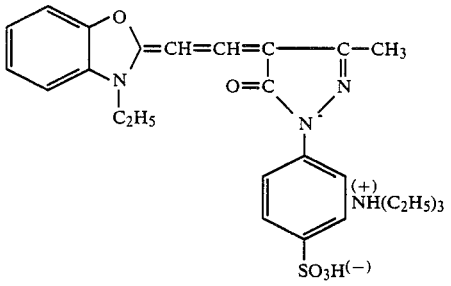
461
e
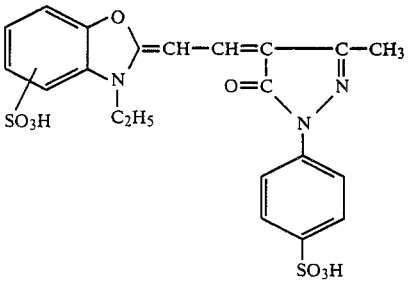
450

-continued
| [Exemplified Compounds] | | |
|---|---|---|
| f | 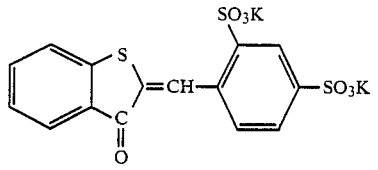 | 445 |
| g | 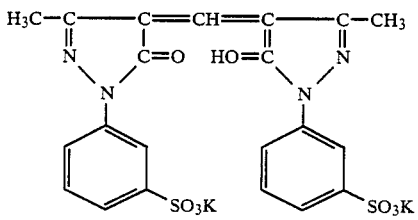 | 415 |
| h | 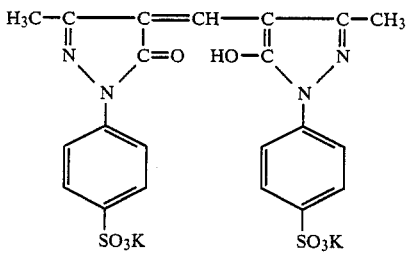 | 420 |
| i | 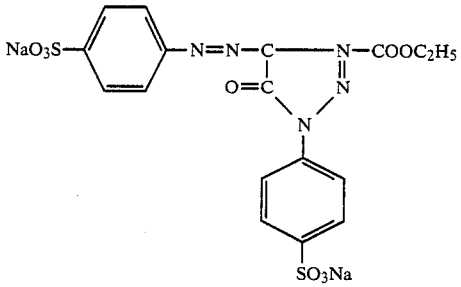 | 480 |
| j | 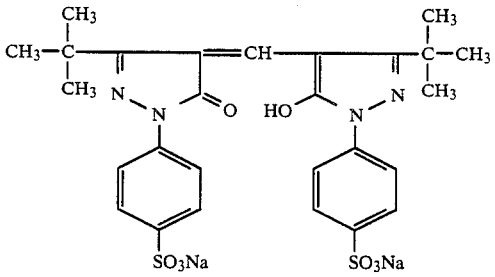 | 425 |
| k | 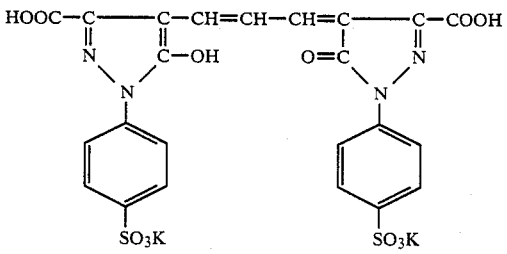 | 520 |

-continued
[Exemplified Compounds]
| | | |
|---|---|---|
| l | 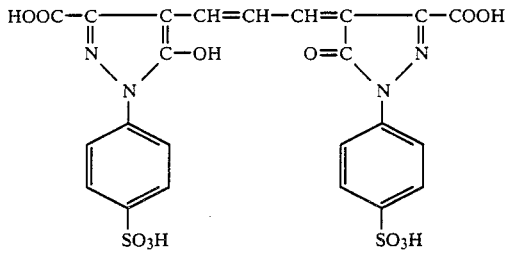 | 545 |
| m | 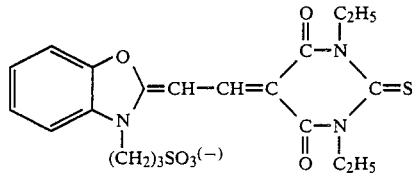 <br> $HN(C_2H_5)_3^{(+)}$ | 459 |
| n | 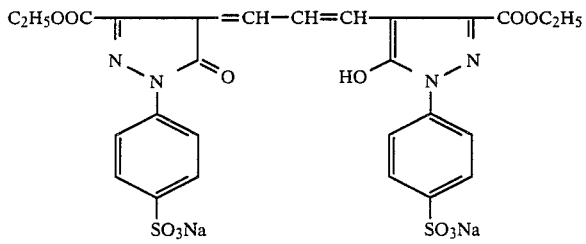 | 558 |
| o | 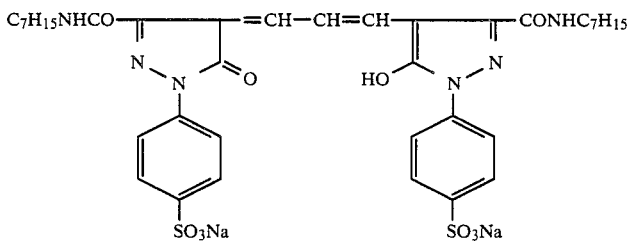 | 545 |
| p | 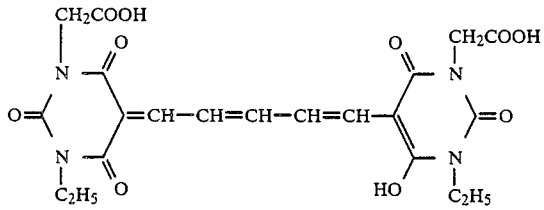 | 590 |
| q | 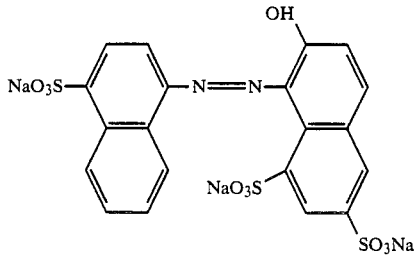 | 508 |
Any necessary one can be selected from the above dye compounds according to the purpose for which the light-sensitive material is used. The particularly preferred compounds are those having the following Formula [IV]:

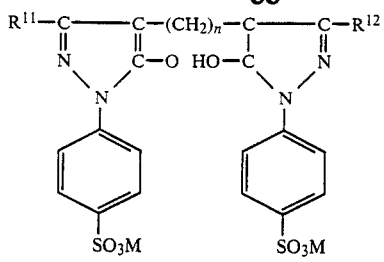

[Formula [IV]

wherein $R^{11}$ and $R^{12}$ each is an alkyl, carboxyl, alkoxycarbonyl or alkylaminocarbonyl group each having from 1 to 7 carbon atoms, an amino group, acylamino group or trifluoromethyl group; M is a hydrogen atom, an alkali metallic atom or an ammonium group; and n is 1 to 3.

The above exemplified dyes can be easily synthesized by those methods as described in, e.g., British Pat. No. 560,385, U.S. Pat. No. 1,884,035, Japanese Patent Examined Publication No. 22069/1964, and the like.

Solvents for use in dissolving these dyes are not particularly specified, but they are desirable to be ones compatible with the hydrophilic colloid for the light-sensitive material. For example, they are used by being dissolved into water or hydrophilic organic solvents (such as methanol, acetone).

The component layer into which such the dye should be incorporated may be any layer of the light-sensitive material; that is, at least any one of the light-sensitive emulsion layer and other hydrophilic colloid layers (nonlight-sensitive layers such as the interlayer, protective layer, subbing layer, etc.) on the emulsion-coated side of the support. The dye is desirable to be present in the silver halide emulsion layer or in a layer closer to the support, and more desirable to be incorporated into a coated layer contiguous to the transparent support.

The adding quantity of each of the magenta-filter function (maximum wavelength 500–600 nm)-having dye and yellow-filter function (maximum wavelength 400–500 nm)-having dye is from 0.5 $mg/m^2$ to 1 $g/m^2$, and preferably from 1 $mg/m^2$to 100 $mg/m^2$. The addition of these dyes may be made at any stage of the manufacturing process of the light-sensitive material, and preferably at a stage immediately before the coating process for the convenience of the operation.

These dyes functioning as the filter dye may be introduced into a hydrophilic colloid layer in usual manner.

In order to apply the present invention to a color light-sensitive material, the procedure and materials for use in ordinary color light-sensitive materials should be applied which are carried out in the manner of incorporating cyan, magenta and yellow couplers in combination into the present invention's emulsion separately sensitized to red, green and blue colors, respectively.

Useful couplers include open-chain methylene-type yellow couplers, pyrazolone-type magenta couplers, and phenol or naphthol-type cyan couplers. In combination with these couplers it is also possible to use automasking colored couplers (such as those couplers with a split-off group having an azo group as a linkage group at the active site thereof), osazone-type compounds, development diffusible dye releasing-type couplers, development inhibitor releasing-type compounds (including both types of compounds which react with the oxidized product of an aromatic priamary amine developing agent to form color dyes, the so-called DIR coupler, and to form colorless dyes, the so-called DIR material), and the like. The incorporation of these couplers into the silver halide color photographic light-sensitive material can be carried out by use of conventionally known various techniques which have been applied to couplers.

The silver halide photographic light-sensitive material of this invention can be obtained by coating the above-mentioned emulsion on a support.

In the silver halide photographic light-sensitive material of this invention, where two or more silver halide emulsions different in the average grain size are used, these emulsions may be coated in the form of separate layers or may also be mixed and coated in the form of a single layer.

Usable materials for the support of the silver halide photographic emulsion of this invention include all discretional ones: for example, polyester film such as polyethylene terephthalate film, polyamide film, polycarbonate film, styrene film, baryta paper, synthetic high-molecular material-laminated paper, and the like. And on either one side or both sides of the support may be coated the emulsion of this invention. Where the emulsion is coated on both sides, the emulsion may be coated so as to make its construction symmetric or asymmetric with respect to the support.

The present invention is applicable to all types of silver halide photographic light-sensitive materials, and particularly suitable for high-speed black-and-white or color negative light-sensitive materials and the like. Where the emulsion is applied to the medical radiography, it is desirable that, for example, a fluorescent intensifying screen comprised mainly of a phosphor emitting near ultraviolet or visible rays by transmissive radiation exposure be used and contacted with both sides of the silver halide material of this invention, and the silver halide material be exposed to the radiation. The transmissive radiation used herein means high-energy electromagnetic waves, including X rays and $\gamma$ rays. And the fluorescent intensifying screen includes the intensifying screen comprised mainly of, e.g., calcium tungstate ($CaWO_4$) and fluorescent intensifying screen containing a terbium-activated rare-earth compound as the main fluorescent component.

The silver halide photographic light-sensitive material of this invention may be processed by any of those known methods generally used. For black-and-white development, any of those developer solutions usually used which contain, e.g., hydroquinone, 1-phenyl-3-pyrazolidone, N-methyl-p-aminophenol or p-phenylenediamine, etc., alone or in combination may be used, and as for other additives therefor, those used in common may be used. Where the light-sensitive material is one for color photography use, it can be color-developed by any of those color development methods usually used.

An aldehyde hardener-containing developer solution may also be used for developing the silver halide photographic light-sensitive material of this invention. For example, various developer solutions such as those containing, e.g., dialdehydes such as maleic dialdehyde or glutaraldehyde or sodium hydrogensulfite salts of these compounds may be used.

The photographic emulsions used in the invention may be exposed to light by making suitably selective use of various kinds of light sources such as tungsten, a fluorescent lamp, a mercury lamp, an arc lamp, xenon, daylight, xenonflash, a cathode-ray tube flying spot, a laser beam, an electron beam, an X-rays, an X-ray intensifying screen and the like.

Exposures may ordinarily be made for a period of from 1/1000 to 100 seconds and, besides, a substantially short time exposure of from $1/10^4$ to $1/10^9$ seconds may also be applied thereto.

EXAMPLES

The invention will now be described further in detail, referring to the preferred embodiments thereof. It is the matter of course that the invention shall not be limited thereto.

EXAMPLE 1

A polydisperse type emulsion I-1 was prepared in a normal precipitation process.

First, the following four kinds of solutions were prepared:

| | | |
|---|---|---|
| Solution A: | Silver nitrate | 100 g |
| | Aqueous ammonia (28%) | 78 cc |
| | Add water to make | 240 cc |
| Solution B: | Ossein gelatin | 8 g |
| | Potassium bromide | 80 g |
| | Potassium iodide | 1.3 g |
| | Add water to make | 550 cc |
| Solution C: | Aqueous ammonia | 6 cc |
| | Glacial acetic acid | 10 cc |
| | Water | 34 cc |
| Solution D: | Glacial acetic acid | 226 cc |
| | Add water to make | 400 cc |

Solutions B and C were poured into a reaction tank and were then stirred ba making use of a propeller type stirrer revolving at 300 r.p.m., and the reaction temperature was kept at 55° C. Next, Solution A was divided into two parts in an proportion of 1:2 by volume, and the 1 part thereof by volume, that is, 100 ml, was poured into the tank, taking one minute. After a continuous stirring for 10 minutes, the remaining 2 parts by volume of Solution A, that is, 200 ml, were poured into the tank and were further stirred continuously for another 30 minutes. Then, Solution D was added, and the pH value of the solution in the tank was adjusted to 6, whereupon the reaction was stopped. Thus, the polydisperse type emulsion I-1 was resulted (See Table 1).

Next, a silver iodide emulsion, which contains silver iodide in an amount of 2.0 mol% and has as average grain-size of 0.3 μm, was prepared in a double-jet process, with adjusting the temperature to 60° C., the pAg to 8 and the pH to 2.0, all the while.

When this emulsion was photographed by making use of an electron microscope, it was found that this emulsion was a silver bromide monodisperse cubic system emulsion (A) whose crystallinity of the twin-crystallized grains thereof was not more than 1% in number. This emulsion was so added as to serve as the seed crystals to 8.5 liter of a solution containing a protective gelatin kept to 40° C., and ammonia if required to add therein, and dispersed. The pH value of the resulted solution was further adjusted with glacial acetic acid.

To the resulted solution serving as the mother liquid, an aqueous ammoniacal silver ion solution prescribed to 3.2. was added while the flow rate was being adjusted in a double-jet process, and the layers containing various amounts of silver iodide were formed in order, respectively. In the formation of these layers, when the layers each containing silver iodide in an amount of not less than 20 mol%, they were prepared by controlling the pAg to 7.3 as shown in FIG. 1, and the pH to 9.7, respectively. And, the layers each containing silver iodide in an amount of less than 20 mol% were prepared by controlling the pAg to 9.0 or not less than 9.0. Namely, as shown in FIG. 1, the layers each containing silver iodide in an amount of not less than 20 mol% were formed until the silver amount became 0.07 of the silver amount used for preparing total silver halide and, thereafter, the layers each containing silver iodide in an amount of not more than 20 mol% were prepared according to the patterns of from (1) to (10) shown in FIG. 1. The thickness of each layer was so determined that the whole silver iodide amount could be about 2 mol%. In the preparation of the multilayered structure, a potassium bromide solution containing an arbitrary amount of potassium iodide was continuously added and the potassium bromide solution was replaced by another potassium bromide solution having a different concentration at the time when a desired thickness of the layers was obtained in terms of silver amount.

In the above-mentioned processes, there obtained the monodisperse type emulsions, I-2 to I-18, as shown in Table 1. Further, the emulsion, I-22, was obtained in such a manner that the emulsion, I-2, was prepared and was then ripened by adjusting the pAg to 11.0 and taking 3 minutes. Still further, emulsions, I-23 to I-25, were obtained in such a manner that the emulsion A was dissolved in a protective gelatin solution and the resulted solution was added with a potassium iodide solution while it was being stirred satisfactorily at 75° C. for 20 minuted and the less silver iodide containing layers were formed in the same way as mentioned above. The average grain-size of every layer prepared was of the order of 0.8 μm.

A gold-sulfur sensitization were applied succesively to the above-mentioned emulsions, by adding ammonium thiocyanate, chloroauric acid and hypo.

The resulted sensitized emulsions were added with an ordinary type stabilizer, hardener and coating assistant and then uniformly coated on both sides of a polyethyleneterephthalate film base previously coated thereon with a subbing liquid that was a copolymer-dispersed aqueous-solution obtained from the copolymer which was comprised of three kinds of monomers, i.e., glycidyl methacrylate at 50 wt%, methyl acrylate at 10 wt% and butyl methacrylate at 40 wt% and was so diluted as to be at 10 wt% in concentration of the copolymer; and the coated emulsions were dried up, so that each of the sensitometric samples, No. 1 through No. 26 were obtained.

Each of the samples was exposed to light through a wedge at 3.2 CMS and was then processed, in a 90-second processing, with an XD-90 Developer by making use of QX-1200 Automatic Processor (manufactured by Konishiroku Photo Industry Co., Ltd.), so that the sensitivity of each sample was obtained.

Each sensitivity of the samples was obtained from the reciprocal of a quantity of light necessary for increasing by 1.0 in darkening density through an exposure to light, and it is expressed in a relative value to the sensitivity value of Sample No. 2 shown in Table 1 which is regarded as the standard value of 100.

TABLE 1

| Sample No. | Emulsion No. | AgI content, mol % 1st layer | 2nd layer | 3rd layer | 4th layer | pAg controlling pattern | Fog | Relative sensitivity | Remark |
|---|---|---|---|---|---|---|---|---|---|
| 1 | 1-1 | — | — | — | — | — | 0.02 | 80 | Comparative |
| 2 | 1-2 | 35 | 0 | — | — | (1) | 0.04 | 100 | " |
| 3 | 1-3 | 35 | 0.4 | — | — | (1) | 0.05 | 95 | " |
| 4 | 1-4 | 35 | 0.4 | — | — | (1) | 0.04 | 100 | " |
| 5 | 1-5 | 35 | 25 | 0.8 | 0.4 | (1) | 0.03 | 95 | " |
| 6 | 1-6 | 35 | 0 | — | — | (2) | 0.03 | 125 | Invention |
| 7 | 1-7 | 35 | 0 | — | — | (3) | 0.02 | 130 | " |
| 8 | 1-8 | 35 | 0 | — | — | (4) | 0.03 | 135 | " |
| 9 | 1-9 | 35 | 0 | — | — | (5) | 0.02 | 140 | " |
| 10 | 1-10 | 35 | 0 | — | — | (6) | 0.03 | 138 | " |
| 11 | 1-11 | 35 | 0 | — | — | (7) | 0.03 | 125 | " |
| 12 | 1-12 | 35 | 0 | — | — | (8) | 0.04 | 98 | Comparative |
| 13 | 1-13 | 35 | 0 | — | — | (5) | 0.02 | 135 | Invention |
| 14 | 1-14 | 35 | 0.4 | — | — | (7) | 0.03 | 120 | " |
| 15 | 1-15 | 35 | 0.4 | — | — | (8) | 0.04 | 95 | Comparative |
| 16 | 1-16 | 35 | 0.8 | 0 | — | (5) | 0.02 | 138 | Invention |
| 17 | 1-17 | 35 | 0.8 | 0.4 | — | (5) | 0.03 | 130 | " |
| 18 | 1-18 | 35 | 25 | 0 | — | (6) | 0.02 | 135 | " |
| 19 | 1-19 | 35 | 25 | 0.4 | — | (6) | 0.02 | 130 | Invention |
| 20 | 1-20 | 35 | 25 | 0.4 | 0 | (3) | 0.02 | 140 | " |
| 21 | 1-21 | 35 | 25 | 0.8 | 0.4 | (3) | 0.03 | 135 | " |
| 22 | 1-22 | 35 | 0 | — | — | (1) except that riped for 3' at pAg 11 after the end of addition of the silver and the halide solution. | 0.03 | 100 | " |
| 23 | 1-23 | KI substitution method | 0.4 | — | — | (3) | 0.02 | 140 | Invention |
| 24 | 1-24 | KI substitution method | 0.4 | 0 | — | (6) | 0.02 | 140 | " |
| 25 | 1-25 | KI substitution method | 0.8 | 0.4 | — | (6) | 0.02 | 138 | " |
| 26 | 1-26 | 2 | 0 | — | — | pAg = 9.0 constantly. | 0.04 | 90 | Comparative |
| 27 | 1-27 | 35 | 0 | — | — | (9) | 0.03 | 138 | Invention |
| 28 | 1-28 | 35 | 0 | — | — | (10) | 0.03 | 115 | " |

(Note)
A layer denoted herein by a bigger figure means the layer is more closer to the outer surface of a grain.

From the above Table 1, it is understood that every one of Samples No. 6 through No. 11, No. 13, No. 14, No. 16 through No. 21, No. 23 through No. 25, No. 27 and No. 28 relating to the invention is substantially high in sensitivity, and it is also understood from the comparison of Samples No. 6 through No. 11 and No. 27 and No. 28 that the effects of the invention can be displayed in the samples relating to the invention which are gradually increased in the variation of pAg value within the range of from ⅔ to 9/10 of an amount of silver used for preparing the samples. It is further understood from the comparison of Samples No. 11, No. 12 and No. 6 through No. 10 that the effects of the invention can also be displayed in the samples having a pAg value of not less than 10.1 when completing the samples thereof.

In contrast to the above, there is no improvement observed in sensitivity of every Comparative Examples No. 1 through No. 5, No. 12, No. 15, No. 22 and No. 26.

EXAMPLE 2

Emulsions I-2, I-7, I-13, I-16, I-17, I-23, I-24 and I-26, which were used in Example 1, were so added with ammonium thiocyanate, an iron chloride salt and hypo as to apply a gold-sulfur sensitiation and were then so added with at least one of the following compounds (1), (2) and (3) as to apply a optical sensitizer. Thereafter, the resulted sensitized emulsions were added with an ordinary type stabilizer, hardener, coating assistant and the aforegiven Compounds A and B, and then uniformly coated on both sides of a polyethyleneterephthalate film base previously coated thereon with a subbing liquid that was a copolymer-dispersed aqueous-solution obtained from the copolymer which was comprised of three kinds of monomers, i.e., glycidyl methacrylate at 50 wt%, methyl acrylate at 10 wt% and butyl methacrylate at 40 wt% and was so diluted as to be at 10 wt% in concentration of the copolymer; and the coated emulsions were dried up, so that each of the sensitometric Samples, No. 27 through No. 45 shown in Table 2 were obtained.

Compound (1)

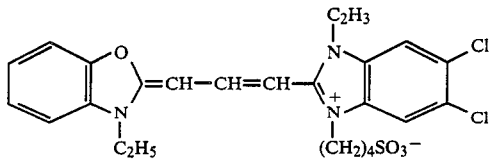

Compound (2)

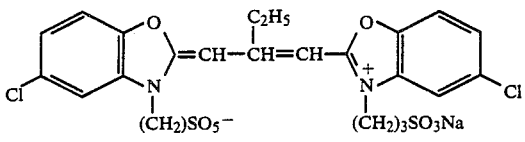

Compound (3)

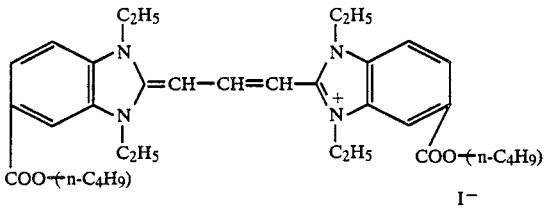

Each of the Samples shown in Table 2 was exposed to light and devloped in the same manner as in Example 1, and the fogginess and sensitivity thereof were obtained in the same manner as in Example 1. The sensitivity of each sample is shown in terms of a relative value to the sensitivity of Sample No. 28 regarded as the standard value of 100, and an amount of optical sensitizer added is in terms of an amount thereof per mol of silver halide used.

As is obvious from Table 2, it is proved that every one of Samples No. 32 through No. 45 relating to the invention is substantially less in fogginess as well as high in sensitivity.

TABLE 2

| Sample No. | Emulsion No. | Optical sensitizer added | Amount added (in mg/mol Ag) | Fog | Sensitivity |
|---|---|---|---|---|---|
| 27 | I-26 | (1) | 150 mg | 0.04 | 60 |
| 28 | I-2 | (1) | 150 mg | 0.03 | 100 |
| 29 | I-2 | (2) | 230 mg | 0.03 | 75 |
| 30 | I-2 | (2) | 180 mg | 0.04 | 70 |
| 31 | I-2 | (2) + (3) | 200 mg + 150 mg | 0.04 | 70 |
| 32 | I-7 | (1) | 150 mg | 0.03 | 150 |
| 33 | I-7 | (2) | 230 mg | 0.02 | 140 |
| 34 | I-7 | (3) | 180 mg | 0.03 | 125 |
| 35 | I-7 | (2) + (3) | 200 mg + 150 mg | 0.02 | 150 |
| 36 | I-13 | (1) | 150 mg | 0.03 | 140 |
| 37 | I-13 | (2) | 230 mg | 0.02 | 148 |
| 38 | I-13 | (3) | 180 mg | 0.03 | 130 |
| 39 | I-13 | (1) + (3) | 200 mg + 150 mg | 0.03 | 125 |
| 40 | I-16 | (2) | 230 mg | 0.02 | 145 |
| 41 | I-16 | (2) + (3) | 200 mg + 150 mg | 0.02 | 152 |
| 42 | I-17 | (1) | 230 mg | 0.03 | 148 |
| 43 | I-17 | (1) + (2) | 200 mg + 200 mg | 0.03 | 135 |
| 44 | I-23 | (2) + (3) | 200 mg + 150 mg | 0.02 | 145 |
| 45 | I-24 | (1) | 150 mg | 0.03 | 145 |

EXAMPLE 3

The silver halide emulsions of the following A, B, C and D types were prepared, respectively, and were then mixed up so as to prepared the photographic light-sensitive material for radiographic use.

Among the emulsions, the types A and B are the emulsions prepared not in accordance with the invention, but the types C and D are those containing the silver halide grains relating to the invention.

TYPE A

Silver iodobromide monodisperse cubic-grain emulsion and monodisperse spheric-grain emulsion containing 2.5 mole% silver iodide and having an average grain size of 0.25μ were obtained by the double-jet method under the controlled conditions of 60° C., pg=8 and pH=2. Part of the emulsion was used as seed crystals. The seed crystals were added to a solution kept at 40° C. containing protective gelatin and a necessary quantity of ammonia, and further glacial acetic acid and a KBr solution were added to adjust the pH and pAg of the liquid.

To the above seed crystals-containing gelatin solution at 40° C. were added a 3.2N ammoniacal silver nitrate solution and a potassium bromide solution containing 2.0 mole% potassium iodide by the double-jet method under the conditions of pAg=9.0 and pH being varied from 9 to 8 during the addition of the silver salt solution. The addition of the ammoniacal silver nitrate solution and potassium bromide solution by the double-jet method was further continued with the pAg and pH kept at 9.0 and 8.0, respectively, whereby pure silver bromide shells were formed. In this manner grains having average grain sizes of 0.40μ, 0.55μ, 0.75μ and 0.95μ were obtained.

TYPE B

In accordance with the full ammonia normally mixing method, silver iodobromide twin-type polydisperse grains containing 2.5 mole% silver iodide and having average grains sizes of 0.40μ, 0.55μ, 0.75μ and 0.95μ were obtained.

TYPE C

Figure 2:
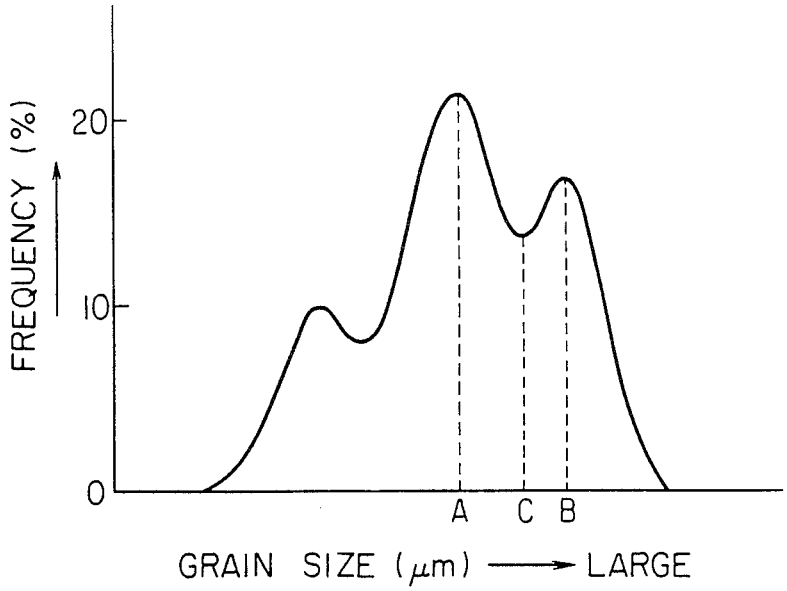
FIG. 2 is a graph illustrating the grain-size distribution of silver halide grains used in the radiographic light-sensitive material relating to the invention.
Figure 3:
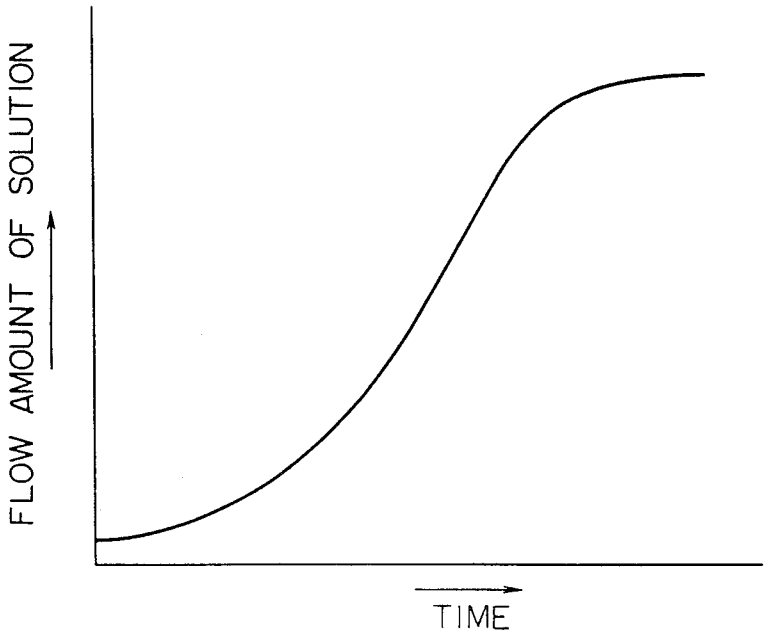
FIG. 3 is a graph illustrating a model of change on standing of flow rates of a silver salt solution and a halide solution added in a double-jet process, in the course of preparing the emulsions in the examples.

Silver halide grains were grown by making use of the same seed crystals as those used in Type A. Namely, the seed crystals were added to a solution kept at 40° C. containing protective gelatin and a necessary quantity of ammonia, and further glacial acetic acid and a KBr solution were added to adjust the pH and pAg of the liquid. This liquid was used as the mother liquid, and to this, with vigorously stirring, were added a 3.2N ammoniacal silver nitrate solution containing an amoun of silver equivalent to 1/15 of the total amount of silver used, and an aqueous halide solution by containing the above-mentioned amount of silver and an amount of potassium iodide equivalent to 30 mole% of the silver halide produced, the double-jet method in a flow pattern as shown in FIG. 2, thus mixing both solutions. That is, by making the ammonia concentration of the mother liquid 0.6N, pH 9.7, and pAg 7.6, the silver iodobromide containing 30 mole% silver iodide was grown over the seed crystals. Then, the pAg was kept at 9.0 constant, and the remaining ammoniacal silver nitrate solution and the aqueous potassium bromide solution were added under the condition mentioned below, whereby varying the pH from 9 to 8 during the addition thereof the pure silver bromide shells were formed.

As shown by the pattern (9) in FIG. 1, the pAg values were so adjusted in the course of forming the shell layer as to be at 9.0 from the initial stage to the stage where an amount of silver added reached ⅔ of a total amount of silver used for forming the grains and as to then be increased gradually up to 11.0 at the time when the silver addition was completed. Taking the above-mentioned manner but by changing the amounts of the seed crystals, there prepared three kinds of emulsions of 1.05μ, 0.65μ and 0.52μ in grain-size, respectively. The average silver iodide content of the each silver halide grain was about 2.0 mol%.

TYPE D

In the same manner as taken in Type C, the portions each containing a 30 mol% silver iodide were formed on the seed crystals, and the shells were formed by making use of a halide solution containing potassium iodide and potassium bromide in the proportion of 0.5:95.5 in terms of mol% in place of an aqueous potassium bromide solution used in Type C. In the above-mentioned processes, the adjustment of pAg values was made in the same manner as in the case of Type C. The three kinds of the emulsions thus prepared were of 1.05, 0.65 and 0.52 in average grain-size.

The emulsions of Types A, B, C and D were added with the sensitizers in the amounts of $1.0\times10^{-18}$ mole/$\mu m^2$ chloroauric acid, $1.0\times10^{-15}$ mole/$\mu m^2$ of sodium thiosulfate and $1.5\times10^{-14}$ mole/$\mu m^2$ of sodium thiocyanate and were then subjected to chemical ripening so as to have them produce a fog of 0.03.

The samples No. 101 through 108 were prepared in such a manner that the obtained emulsions were mixed in the mixing proportions as given in Table 3, and to the differently mixed emulsions were added various additives such as stabilizer, antifoggant, coating aid, hardener, etc, in the same quantities, and then each mixed emulsion was coated on both sides of a blue-tinted polyethylene terephthalate base so that the coating amount of silver is 50 mg/$dm^2$.

The obtained samples were allowed to stand for three days under the atmospheric condition of a relative humidity of 45% at 55° C. for the purpose of a forced deterioration test. Further, for comparison, the samples were allowed to stand for three days under the condition of a relative humidity of 55% at 23° C.

With respect to each of the samples, the photographic characteristics thereof were measured by sensitometry in the following method, and, with respect to the Samples not applied with any torture, the diagnostic characteristics thereof were evaluated and the safety light fogs were also tested. Wherein, the gamma values were of the samples not applied with any torture.

TABLE 3

| Sample No. | Emulsion (grain size μm/type) | mixing ratio | |
|---|---|---|---|
| 101 | 0.75/B: | | Comparative |
| 102 | 0.95/A:0.75/A:0.55/A | 20:50:30 | " |
| 103 | 1.05/B:0.75/A:0.55/A | 25:50:25 | " |
| 104 | 1.95/A:0.75/B:0.55/A | 20:50:30 | " |
| 105 | 1.05/B:0.65/C:0.55/A | 20:50:30 | Invention |
| 106 | 1.05/B:0.65/C:0.52/C | 20:50:30 | " |
| 107 | 1.05/C:0.65/C:0.52/C | 15:55:30 | " |
| 108 | 1.05/B:0.65/D:0.52/D | 20:50:30 | " |
| 109 | 1.05/D:0.65/D:0.52/D | 25:50:25 | " |

The exposure of each sample is made in the manner that the radiographic light-sensitive material sample having a light-sensitive emulsion layer on both sides (or one side) of the support thereof is placed between a pair of optical wedges whose density inclinations are mirror-symmetically arranged, and the light-sensitive material sample is exposed simultaneously for 1/12.5 seconds to the lights from light sources of a color temperature of 5,400° K. arranged on both opposite sides. The processing of each sample is made in a roller transport-type automatic processor in accordance with the following steps:

| | Temperature | Time |
|---|---|---|
| Developing | 35° C. | 30 seconds |
| Fixing | 34° C. | 20 seconds |
| Washing | 33° C. | 18 seconds |
| Drying | 45° C. | 22 seconds |

| Developer solution-1 | |
|---|---|
| Potassium sulfite | 55.5 g |
| Hydroquinone | 25.0 g |
| 1-phenyl-3-pyrazolidone | 1.2 g |
| Boric acid | 10.0 g |
| Potassium hydroxide | 21.0 g |
| Triethylene glycol | 17.5 g |
| 5-methylbenzotriazole | 0.04 g |
| 5-nitrobenzimidazole | 0.11 g |
| 1-phenyl-5-mercaptotetrazole | 0.015 g |
| Glutaraldehyde hydrogensulfite | 15.0 g |
| Glacial acetic acid | 16.0 g |
| Potassium bromide | 4.0 g |
| Add water to make 1 liter | |

As for the fixer solution to be used, any one can be used as long as it is an acid hardening fixer solution, for example, SAKURA XF (product of Konishiroku Photo Industry Co., Ltd.) may be used. From the characteristic curve prepared, the reciprocal of the exposure in the base density+fog density+0.1 was found, whereby a relative sensitivity was obtained.

A chest phantom was used for evaluating the aptitude of the light-sensitive material sample for diagnosis, and the sample was exposed through the phantom to X rays. As the intensifying screen, SAKURA Screen NS (product of Konishiroku Photo Industry Co., Ltd.) was used. The processing in this test was made in the same manner as aforementioned. The evaluation was made by eye, and the results were graded as follows: N . . . normal level, G . . . excellent level, L . . . worse level than normal.

As for the fog of each sample due to a safelight, the foregoing coated sample was placed for one hour at a distance of one meter from and under a safelight of a 20 W incendescent lamp with a SAKURA Red Safeflight Filter Hilite attached thereto, and the sample was then processed in like manner, and after that the fog due to the safelight was measured.

Table 4 shows the results of preservability, safelight fog, gamma and apptitude for diagnosis.

TABLE 4

| | 23° C., 55% RH | | 55° C., 45 RH | | | | | |
|---|---|---|---|---|---|---|---|---|
| Sample No. | Fog | Sensitivity | Fog | Sensitivity | $\gamma_1$ | $\gamma_2$ | Safelight fog | diagnosis |
| 101 | 0.03 | 100 | 0.07 | 118 | 0.4 | 2.4 | 0.11 | L |
| 102 | 0.03 | 100 | 0.03 | 100 | 0.20 | 2.7 | 0.10 | N |
| 103 | 0.03 | 102 | 0.07 | 108 | 0.6 | 2.45 | 0.11 | N |
| 104 | 0.03 | 100 | 0.08 | 114 | 0.9 | 2.4 | 0.11 | N |
| 105 | 0.03 | 120 | 0.05 | 118 | 0.95 | 2.6 | 0.04 | G |
| 106 | 0.03 | 120 | 0.05 | 120 | 0.9 | 2.65 | 0.03 | G |
| 107 | 0.03 | 130 | 0.03 | 130 | 0.70 | 3.2 | 0.02 | G |
| 108 | 0.03 | 130 | 0.04 | 120 | 0.55 | 3.0 | 0.04 | G |
| 109 | 0.03 | 130 | 0.03 | 130 | 0.75 | 3.1 | 0.02 | G |

From the results shown in Table 3 it is understood that any of Samples Nos. 105 through 109 of the invention is excellent in the preservability (the fog and speed under the condition of 23° C./55% RH and the fog and speed under the condition of 55° C./45% RH) and safelight fog. In addition, the gamma values of these samples as well as in the aptitude for diagnosis are well acceptable.

EXAMPLE 4

In this example, the sensitization by various optical sensitizer was used in combination. That is, the chemically sensitized mixed-emulsion Samples prepared in Example 3 were further optically sensitized by the addition of Optical Sensitizer (1) through (3) thereto, so that the Samples shown in Table 5 were prepared. Upon evaluating them in the same manner as in Example 3, the preservability, safelight fog and aptitude for diagnosis as given in Table 6 were resulted. The photographic speed values shown in Table 6 are relative speeds to the speed of Sample No. 110 as 100.

Table 5 shows the combination of emulsions and optical sensitizers in each sample. The method of the evaluation is the same as in Example 3, and in the actual photographing tests, however, a Sakura Hi-ortho Screen KS (manufactured by Konishiroku Photo Ind. Co., Ltd.) was used to serve as the intensifying screen.

TABLE 5

| Sample No. | Emulsion* | Optical sensitizer No. | Optical sensitizer Amount added (mg/mol Ag) | |
|---|---|---|---|---|
| 111 | 101 | (1) | 150 | Comparative |
| 112 | 102 | (2) | 230 | " |
| 113 | 105 | (2) + (3) | 200 + 50 | Invention |
| 114 | 106 | (1) | 150 | " |
| 115 | 107 | (1) | 150 | " |
| 116 | " | (2) | 230 | " |
| 117 | " | (3) | 180 | " |
| 118 | " | (2) + (3) | 200 + 50 | " |
| 119 | 109 | (2) + (3) | 200 + 50 | " |
| 120 | " | (1) | 150 | " |

*These emulsions are the same as those used in the following numbered samples in Example 3.

The characteristics of each sample are shown in Table 6.

TABLE 6

| Sample No. | 23° C., 55% RH Fog | 23° C., 55% RH Sensitivity | 55° C., 45 RH Fog | 55° C., 45 RH Sensitivity | $\gamma_1$ | $\gamma_2$ | Safelight fog | diagnosis |
|---|---|---|---|---|---|---|---|---|
| 111 | 0.03 | 100 | 0.08 | 98 | 0.4 | 2.3 | 0.09 | L |
| 112 | 0.03 | 100 | 0.09 | 88 | 0.9 | 2.4 | 0.08 | N |
| 113 | 0.03 | 130 | 0.05 | 125 | 0.6 | 2.6 | 0.02 | N |
| 114 | 0.03 | 130 | 0.04 | 127 | 0.7 | 2.9 | 0.03 | G |
| 115 | 0.03 | 130 | 0.04 | 135 | 0.7 | 3.1 | 0.03 | G |
| 116 | 0.03 | 128 | 0.03 | 130 | 0.9 | 2.7 | 0.02 | G |
| 117 | 0.03 | 120 | 0.04 | 130 | 0.9 | 2.8 | 0.03 | G |
| 118 | 0.03 | 135 | 0.03 | 135 | 0.8 | 3.2 | 0.02 | G |
| 120 | 0.03 | 128 | 0.04 | 125 | 0.7 | 3.2 | 0.03 | G |

The Samples No. 114 through No. 120 relating to the invention can display the excellent characteristics in photographic speed, preservability and safelight fog resistance and satisfy the desired values of gamma $\gamma_1$ and gamma $\gamma_2$ as well as display an excellent aptitude for diagnosis.

What is claimed is:

1. A silver halide photographic light-sensitive material, comprising a support and at least one silver halide photographic emulsion layer provided on said support, said at least one silver halide emulsion layer containing a silver halide grain which has a localized portion containing 20 mol% or more silver iodide and average silver iodide content of which grain is from 0.1 to 10 mol%, provided that said silver halide grain is prepared by mixing an aqueous solution containing a water soluble halide compound and an aqueous solution containing a water soluble silver salt under a condition that pAg of the mixture is raised between 9.7 and 12.5 during a period after a half amount of said silver salt to be used has been added to the mixture.

2. The light-sensitive material of claim 1, wherein pAg of said mixture is raised during a period between a point when a half amount of said water soluble silver salt is added and the point when 9/10 of said water soluble silver salt is added to the mixture, and pAg of the mixture at the point when the mixing is completed is between 9.7 and 12.5.

3. The light-sensitive material of claim 2, wherein raising of pAg is carried out continuously or stepwise.

4. The light-sensitive material of claim 1, wherein at least 50% by weight of the total silver halide grains contained in said silver halide emulsion layer is said silver halide grain.

5. The light-sensitive material of claim 1, wherein said silver halide emulsion layer contains a compound represented by the general formula [I], [II] or [III]:

General Formula [I]

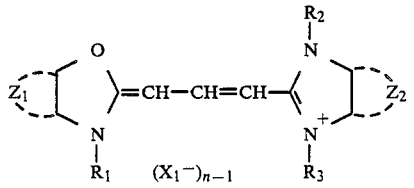

wherein $R_1$, $R_2$ and $R_3$ are independently selected from a substituted or unsubstituted alkyl, alkenyl and aryl group and at least one of $R_1$ and $R_3$ is a sulfoalkyl or carboxyalkyl group, $X_1^-$ is an anion, $Z_1$ and $Z_2$ independently represent a group of nonmetallic atoms necessary to complete a substituted or unsubstituted benzene ring and n represents an integer 1 or 2, provided that when said compound forms an intramolecular salt, n is 1, General Formula [II]

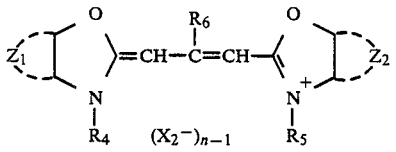

wherein $R_4$ and $R_5$ are independently selected from a substituted or unsubstituted alkyl, alkenyl and aryl group and at least one of them is a sulfoalkyl or carboxyalkyl group, $R_6$ is selected from a hydrogen atom, a lower alkyl and aryl group, $X_2^-$ is an anion, $Z_1$, $Z_2$ and n are respectively the same as defined in the general formula [I], General Formula [III]

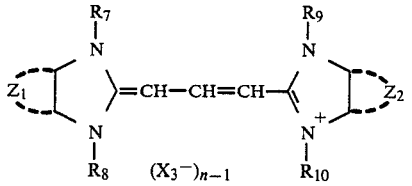

wherein $R_7$ and $R_8$ are independently selected from a substituted or unsubstituted lower alkyl group, $R_9$ and $R_{10}$ are independently selected from a lower alkyl, hydroxylalkyl, sulfoalkyl and carboxyalkyl group, $X_3^-$ is an anion, $Z_1$, $Z_2$ and n are respectively the same as defined in the general formula [I].

6. The light-sensitive material of claim 1, wherein said silver halide grain is sensitized with from $1.0\times10^{-16}$ to $1.0\times10^{-20}$ mol of a gold sensitizer per $\mu m^2$ of the surface area of said silver halide grain.

7. The light-sensitive material of claim 1, wherein $\gamma$ of the line connecting the points respectively corresponding 0.05 and 0.30 of optical density on the characteristic curve of said light-sensitive material ($\gamma_1$) and $\gamma$ of the line connecting the points respectively corresponding 0.50 and 1.50 of optical density on said characteristic curve, of said light-sensitive material ($\gamma_2$) are from 0.5 to 1.0 and from 2.50 to 3.50, respectively, provided that said light-sensitive material is exposed and developed with the following treatment, and the D-Log E characteristic curve is drawn on rectangular coodinates in which optical density D and exposure-amount log E are graduated in the same unit length on each axes:

| treating | temperature | time |
|---|---|---|
| developing | 35° C. | 35 sec. |
| fixing | 34° C. | 20 sec. |
| washing | 33° C. | 18 sec. |
| drying | 45° C. | 22 sec. |

| [Developer] | |
|---|---|
| Potassium sulfite | 55.5 g |
| Hydroquinone | 25.0 g |
| 1-phenyl-3-pyrazolidone | 1.2 g |
| Boric acid | 10.0 g |
| Potassium hydroxide | 21.0 g |
| Triethylene glycol | 17.5 g |
| 5-methylbenzotriazole | 0.04 g |
| 5-nitrobenzimidazole | 0.11 g |
| 1-phenyl-5-mercaptotetrazole | 0.015 g |
| Glutaraldehyde bisulfite | 15.5 g |
| Glacial acetic acid | 16.0 g |
| Add water to make | 1000 ml. |

* * * * *